United States Patent [19]

Nakaniwa

[11] Patent Number: 5,048,490

[45] Date of Patent: Sep. 17, 1991

[54] METHOD AND APPARATUS FOR DETECTION AND DIAGNOSIS OF AIR-FUEL RATIO IN FUEL SUPPLY CONTROL SYSTEM OF INTERNAL COMBUSTION ENGINE

[75] Inventor: Shinpei Nakaniwa, Isesaki, Japan

[73] Assignee: Japan Electronic Control Systems Co., Ltd., Isesaki, Japan

[21] Appl. No.: 537,630

[22] Filed: Jun. 14, 1990

[30] Foreign Application Priority Data

Jun. 16, 1989 [JP] Japan ..... 1-152423

[51] Int. Cl.[5] ..... F02D 41/14; F02D 41/22

[52] U.S. Cl. ..... 123/479; 123/489

[58] Field of Search ..... 123/479, 489

[56] References Cited

U.S. PATENT DOCUMENTS

| | | | |
|---|---|---|---|
| 3,938,075 | 2/1976 | Reddy | 123/479 |
| 4,502,443 | 3/1985 | Hasegawa et al. | 123/479 |
| 4,739,740 | 4/1988 | Ohkawara et al. | 123/489 |
| 4,751,908 | 6/1988 | Abe et al. | 123/479 |
| 4,819,601 | 4/1989 | Harada et al. | 123/489 |
| 4,887,576 | 12/1989 | Inamoto et al. | 123/479 |
| 4,951,632 | 8/1990 | Yakuwa et al. | 123/479 |

FOREIGN PATENT DOCUMENTS

| | | | |
|---|---|---|---|
| 0184940 | 9/1985 | Japan | 123/489 |
| 0234265 | 10/1986 | Japan | 123/489 |
| 0075044 | 4/1987 | Japan | 123/489 |
| 2185596 | 7/1987 | United Kingdom | 123/489 |

*Primary Examiner*—Willis R. Wolfe
*Assistant Examiner*—Tom Moulis
*Attorney, Agent, or Firm*—Foley & Lardner

[57] ABSTRACT

In a fuel supply control apparatus constructed so that a fuel supply quantity is feedback-controlled to bring a detected value of an air-fuel ratio of an air-fuel mixture sucked in an engine to a target air-fuel ratio, a disorder of air-fuel ratio-detecting means is diagnosed based on a change of the balance of the response characteristic of the air-fuel ratio-detecting means in both the change directions of the air-fuel ratio, a change of an output value of the air-fuel ratio-detecting means or a change of the frequency of the feedback control.

12 Claims, 17 Drawing Sheets

METHOD AND APPARATUS FOR DETECTION AND DIAGNOSIS OF AIR-FUEL RATIO IN FUEL SUPPLY CONTROL SYSTEM OF INTERNAL COMBUSTION ENGINE

BACKGROUND OF THE INVENTION (1) Field of the Invention

The present invention relates to a method and apparatus for the detection and diagnosis of an air-fuel ratio in a fuel supply control system of an internal combustion engine. More particularly, the present invention relates to a method and apparatus for diagnosing a disorder of air-fuel ratio-detecting unit for detecting an air-fuel ratio in an air-fuel mixture sucked in an engine based on the concentration of exhaust components in an exhaust gas from an engine in the feedback correction control for bringing the air-fuel ratio in the air-fuel mixture sucked in the engine close to a target value.

(2) Description of the Related Art

As the known fuel supply control system of an internal combustion engine, having a function of feedback control of an air-fuel ratio, the following system can be mentioned.

A sucked air flow quantity Q or sucked air pressure PB is detected as the quantity of the state participating in sucked air, and based on such detected values and the detected value of the engine revolution number N, the basic fuel supply quantity Tp is computed. Then, this basic fuel supply quantity is corrected the amount of this on various correction coefficients COEF set by various driving state factors such as the engine temperature represented by the cooling water temperature, an air-fuel ratio feedback correction coefficient LAMBDA set based on the air-fuel ratio in the air-fuel mixture detected through the oxygen concentration in the exhaust gas and a correction proportion Ts by the battery voltage to compute a final fuel supply quantity ($=Tp\times COEF\times LAMBDA+Ts$), and a fuel in this computed quantity is supplied to the engine through a fueL injection valve or the like (see Japanese Unexamined Patent publication No. 60-240840).

The air-fuel ratio feedback correction coefficient LAMBDA is set, for example, by proportional-integral control, and when the actual air-fuel ratio detected based on the oxygen concentration in the exhaust gas detected by an oxygen sensor is rich (or lean) as compared with the target air-fuel ratio (theoretical air-fuel ratio), the air-fuel ratio feedback correction coefficient LAMBDA is first decreased (or increased) by a proportion constant p and then gradually decreased (or increased) by an integration constant I synchronously or at the same frequency as that of the revolution of the engine. When the actual air-fuel ratio is brought close to the target air-fuel ratio, the changing direction of the air-fuel ratio feedback correction coefficient LAMBDA is reversed and this operation is repeated to effect the control.

As the oxygen sensor for the above-mentioned feedback control of the air-fuel ratio, there is generally used a sensor for detecting whether the actual air-fuel ratio is rich or lean as compared with the target air-fuel ratio by utilizing the phenomenon that the oxygen concentration in the exhaust gas abruptly changes with the target air-fuel ratio being the boundary. This oxygen sensor has a structure in which electrodes are formed on both of the inner and outer surfaces of a zirconia tube, an electromotive force corresponding to the ratio of the oxygen concentration in open air introduced into the inner side of the tube to the oxygen concentration in the exhaust gas to which the outer side of the tube is exposed is generated between the electrodes, and this electromotive force is monitored to indirectly detect the oxygen concentration in the exhaust gas and, in turn, detect whether the air-fuel ratio in the air-fuel mixture sucked in the engine is rich or lean as compared with the theoretical air-fuel ratio (see Japanese Unexamined Utility Model Publication No. 63-51273).

In the above-mentioned system of feedback control of the air-fuel ratio based on the results of the detection by the oxygen sensor, if the output characteristics of the detection signals to the air-fuel ratio are changed from the initial output characteristics by deterioration of the oxygen sensor, it becomes impossible to obtain the target air-fuel ratio (theoretical air-fuel ratio) with high degree of precision by the feedback control.

A ternary catalyst for purging the exhaust gas is often arranged in an exhaust system of an automobile engine. In this ternary catalyst device, a highest conversion efficiency is obtained when an air-fuel mixture is burnt at the theoretical air-fuel ratio. Accordingly, if the feedback-controlled air-fuel ratio deviates from the theoretical air-fuel ratio by the above-mentioned deterioration of the oxygen sensor, the conversion efficiency of the ternary catalyst device is degraded and there arises a problem of an increase of CO, HC and $NO_x$. Furthermore, even in the case where the station characteristics of the oxygen sensor are hardly changed, if the response time of the oxygen sensor is changed from the initial response time when the actual air-fuel ratio is reversed from the rich state to the lean state or vice versa, the control point of the air-fuel ratio deviates from the initial control point (target air-fuel ratio), a problem arises in that a sufficient exhaust gas-purging effect cannot be attained by the ternary catalyst system.

As is apparent from the foregoing description, if deterioration of the oxygen sensor occurs, the feedback-controlled air-fuel ratio deviates from the theoretical air-fuel ratio and this deviation has an adverse influence on the properties of the exhaust gas. However, diagnosis of deterioration of the oxygen sensor is much more difficult than diagnosis of an on-off trouble of a single line such as a break or short circuit, and therefore, development of a diagnosis method or apparatus having high reliability is highly desirable.

SUMMARY OF THE INVENTION

The present invention has been completed with the above-mentioned background in view, and it is an object of the present invention to provide a diagnosis method and apparatus in which deterioration of an apparatus for detecting the air-fuel ratio of an air-fuel mixture sucked in an engine, such as an oxygen sensor, can be diagnosed with a high degree of precision by coping with various deterioration patterns.

In accordance with the present invention, this object can be attained by a method for the detection and diagnosis of an air-fuel ratio in a fuel supply control system of an internal combustion engine, which system comprises air-fuel ratio-detecting means for detecting an air-fuel ratio of an air-fuel mixture sucked in the engine based on the concentration of exhaust components in an exhaust gas from the engine and is constructed so that a fuel supply quantity is feedback-controlled to bring the air-fuel ratio detected by the air-fuel ratio-detecting means close to a target air-fuel ratio, said method comprising performing an operation of proportionally changing a feedback correction value for the feedback control of the fuel supply quantity over a mean value thereof when the air-fuel ratio detected by the air-fuel ratio-detecting means is reversed from the rich level to the lean level relative to the target air-fuel ratio or vice versa, detecting at least one the time of from the point of the start of the proportional changing operation to the point of the start of the change of the air-fuel ratio to the target air-fuel ratio and the ratio of the change of a detection signal of the air-fuel ratio-detecting means during the practice of the operational changing operation, and judging a disorder in the air-fuel ratio-detecting means when at least one of the time and ratio is not substantially equal in both change directions of the air-fuel ratio.

According to this method, by changing the feedback correction value over the mean value thereof when the actual air-fuel ratio is reversed from the rich level to the lean level relative to the target air-fuel ratio or vice versa, correction control of the air-fuel ratio to the target air-fuel ratio at the time of the rich-lean reversal can be performed assuredly and the detection can be carried out without any adverse influence on the response characteristic of the air-fuel ratio-detecting means by the feedback control. according to the practice of this control, a disorder in the air-fuel ratio-detecting means is judged to exist based on whether or not the characteristics of detection of the rich-to-lean change of the air-fuel ratio is different from the characteristics of detection of the lean-to-rich change of the air-fuel ratio. As the parameter for the detection of the above-mentioned detection characteristics, at least one of the time from the start of the proportional changing operation to the start of the change of the air-fuel ratio toward the target air-fuel ratio and the ratio of the change of the detection signal of the air-fuel ratio-detecting means is detected.

When a disorder in the air-fuel ratio-detecting means is judged based on the characteristics at the rich/lean reversal in the above-mentioned manner, this judgment is carried out while the engine is stationary while driven, whereby any misjudgement based on an error in the control of the air-fuel ratio during transient driving of the engine can be avoided.

Furthermore, in the above-mentioned detection and diagnosis of the air-fuel ratio according to the present invention, there can be adopted a method in which after a driving condition where the exhaust gas temperature exceeds a predetermined level is experienced, maximum and minimum values of the signal detected by the air-fuel ratio-detecting means are sampled and a disorder is judged by comparing the maximum and minimum values with the initial values.

According to this method, in the state where a driving state of a predetermined exhaust gas temperature is experienced and the air-fuel ratio-detecting means is sufficiently activated, maximum and minimum values of the detection value by the air-fuel ratio-detecting means are sampled, and therefore, if the characteristics of the air-fuel ratio-detecting means are changed, the maximum and minimum values are changed from the initial values and a disorder in the air-fuel ratio-detecting means can be judged.

Also in this method, the judgment of the disorder based on the maximum and minimum values is carried out only during a stationary state of the driving, whereby misjudgement based on influences on the maximum and minimum values by change of the exhaust gas temperature during transient driving can be avoided.

Furthermore, in the detection and diagnosis of the air-fuel ratio according to the present invention, there can be adopted a method in which the frequency of the control of the feedback correction value for the feedback control of the fuel supply quantity is detected, initial values of this control frequency for respective driving conditions are stored, and the detected control frequency is compared with the initial value of the control frequency stored according to the corresponding driving condition to judge a disorder in the air-fuel ratio-detecting means.

In the initial state of the air-fuel ratio-detecting means, the feedback correction value is controlled at a substantially constant frequency for each driving condition, and therefore, when the detected control frequency is different from the control frequency in the initial state, it is judged that the control frequency is changed by changes of the characteristics of the air-fuel ratio-detecting means.

Since it sometimes happens that the frequency of the control of the feedback correcion value is greatly changed for transient driving where an error of the air-fuel ratio control often occurs, also when the diagnosis is carried out according to this method, it is preferred that the diagnosis be performed while the engine is stationary while driven.

Furthermore, in accordance with the present invention, there is provided an apparatus for the detection and diagnosis of an air-fuel ratio in a fuel supply control system of an internal combustion engine, which system comprises air-fuel ratio-detecting means for emitting a detection signal corresponding the concentration of exhaust components in an exhaust gas from the engine and detecting an air-fuel ratio in an air-fuel mixture sucked in the engine based on the detection signal, feedback correction value-setting means for setting a feedback correction value for feedback-controlling a fuel supply quantity so as to bring the air-fuel ratio detected by the air-fuel ratio-detecting means to a target air-fuel ratio and fuel supply-controlling means for controlling the supply of the fuel to the engine based on the fuel supply quantity corrected based on the feedback correction value set by the feedback correction value-setting means, the apparatus comprising proportional operation-controlling means for causing the feedback correction value-setting means to perform the setting of the feedback correction value by a proportional operation of increasing or decreasing the feedback correction value over at least a mean value of the feedback correction value when rich-lean reversal of the actual air-fuel ratio relative to the target air-fuel ratio is detected by the air-fuel ratio-detecting means, proportional operation result-detecting means for detecting at least one of the time from the start of the proportional operation of increasing or decreasing the feedback correction value by the proportional operation-controlling means to the start of the change of the air-fuel ratio toward the target air-fuel ratio and the ratio of the change of the detection signal of the air-fuel ratio-detecting means, and response level disorder-judging means for judging a disorder in the air-fuel ratio-detecting means when the values detected by the proportional operation result-detecting means in both change directions of the air-fuel ratio are not substantially equal to each other.

In the above-mentioned apparatus, the proportional operation-controlling means is arranged to cause the feedback correction value-setting means to set the feedback correction value by the proportional operation of increasing or decreasing the feedback correction value over at least the mean value of the feedback correction value, that is, the value corresponding to the target air-fuel ratio, when the rich/lean reversal of the actual air-fuel ratio relative to the target air-fuel ratio is detected by the air-fuel ratio-detecting means. For example, when the actual air-fuel ratio is reversed from the rich (or lean) level to the lean (or rich) level relative to the target air-fuel ratio, by proportional operation, a value for correcting the air-fuel ratio to a rich (or lean) level as compared with the target air-fuel ratio is set, whereby the control of the feedback correction value for returning the air-fuel ratio to the target air-fuel ratio can be performed assuredly at the time of the reversal of the air-fuel ratio and the detection can be performed without any influence on the response characteristic of the air-fuel ratio-detecting means by the feedback correction value.

The proportional operation result-detecting means detects at least one the time of from the start of the proportional operation of the feedback correction value by the proportional operation-controlling means to the start of the change of the air-fuel ratio toward the target air-fuel ratio, that is, the time from the control of returning the air-fuel ratio to the target air-fuel ratio to the actual detection of this return by the air-fuel ratio-detecting means, and the ratio of the change of the detection signal of the air-fuel ratio-detecting means.

The response level disorder-judging means judges a disorder in the response level when the values (response times or response speeds) detected by the proportional operation result-detecting means in both changing directions (rich-to-lean and lean-to-rich directions) are not substantially equal to each other, that is, when the characteristic of detecting the rich-to-lean change of the air-fuel ratio is different from the characteristic of detecting the lean-to-rich change of the air-fuel ratio.

The above-mentioned apparatus for the detection and diagnosis of an air-fuel ratio can further comprise maximum value-sampling and minimum value-sampling means for sampling maximum and minimum values of the detection signal given by the air-fuel ratio-detecting means, high exhaust gas temperature occurrence-judging means for judging the occurrence of a driving condition where the exhaust gas temperature is higher than a predetermined level, and output level disorder-judging means for judging a disorder in the air-fuel ratio-detecting means by comparing the maximum and minimum values sampled by the maximum value- and minimum value-sampling means with the initial values when the occurrence of the driving condition where the exhaust gas temperature is higher than the predetermined level is judged to exist.

In this apparatus, the maximum value- and minimum value-sampling means samples the maximum and minimum values of the detection signal emitted by the air-fuel ratio-detecting means.

The high exhaust gas temperature occurrence means judges the occurrence of the driving condition where the exhaust gas temperature is higher than the predetermined level, and the output level disorder-judging means judges a disorder in the air-fuel ratio-detecting means by comparing the sampled maximum and minimum values with the initial values when the occurrence of the high exhaust gas temperature is judged to exist.

Namely, if the high exhaust gas temperature activating the air-fuel ratio-detecting means occurs, a larger maximum value and a smaller minimum value than those sampled at low exhaust gas temperatures should be sampled according to the high exhaust gas temperature, and if a disorder is brought about by deterioration of the air-fuel ratio-detecting means or the like, the initial maximum and minimum values at this exhaust gas temperature are changed and hence, a disorder in the output level of the air-fuel ratio-detecting means is judged.

The diagnosis apparatus of the present invention can further comprise control frequency-detecting means for detecting the control frequency of the feedback correction value set by the feedback correction value-setting means, initial value-storing means for storing the initial value of the control frequency of the feedback correction value according to the driving condition, and control frequency disorder-judging means for judging a disorder in the air-fuel ratio-detecting means by comparing the control frequency of the feedback correction value detected by the control frequency-detecting means with the initial value of the control frequency, stored in the initial value-storing means, according to said driving condition.

In the apparatus having the above structure, the initial value-storing means stores the initial value of the control frequency of the feedback correction value according to the driving condition, and the control frequency-detecting means detects the control frequency of the feedback correction value set by the feedback correction value-setting means. The control frequency disorder-judging means judges a disorder in the control frequency of the air-fuel ratio-detecting means by comparing the detected control frequency of the feedback correction value with the initial value of the control frequency, stored in the initial value-storing means, according to the driving condition.

Namely, the frequency of the control by the feedback correction value varies according to the driving condition, and even if control frequencies detected under different driving conditions are compared, a disorder in the air-fuel ratio-detecting means cannot be judged. Accordingly, initial control frequencies for respective driving conditions are independently stored, and the detected frequency is compared with the stored initial value for the same driving condition as the driving condition under which said frequency is detected and the change between the detected control frequency and the initial value of the control frequency is detected. Based on the detected change, a disorder in the control frequency of the air-fuel ratio-detecting means is judged.

In the apparatus for the detection and diagnosis of the air-fuel ratio, which is capable of judging a disorder in the air-fuel ratio-detecting means in the above-mentioned manner, only when a stationary driving state of the engine is detected by stationary driving state-detecting means, disorder judgment-allowing means allows the judgment of the disorder in the air-fuel ratio-detecting means, whereby misjudgement based on a response level, output level or control frequency detected in the transient driving state where the air-fuel ratio is rendered extremely lean or rich can be avoided.

Other objects and aspects of the present invention will become apparent from the following detailed description of the embodiment of the present invention made with reference to the accompanying drawings.

BRIEF DESCRIPTION OF THE DRAWINGS

FIGS. 5-1, 5-2, 5-3, 5-4, 6, 7-1, 7-2 and 8 through 10 are flow charts showing contents of controls in the above-mentioned embodiment.

DETAILED DESCRIPTION OF THE PREFERRED EMBODIMENT

Figure 1:
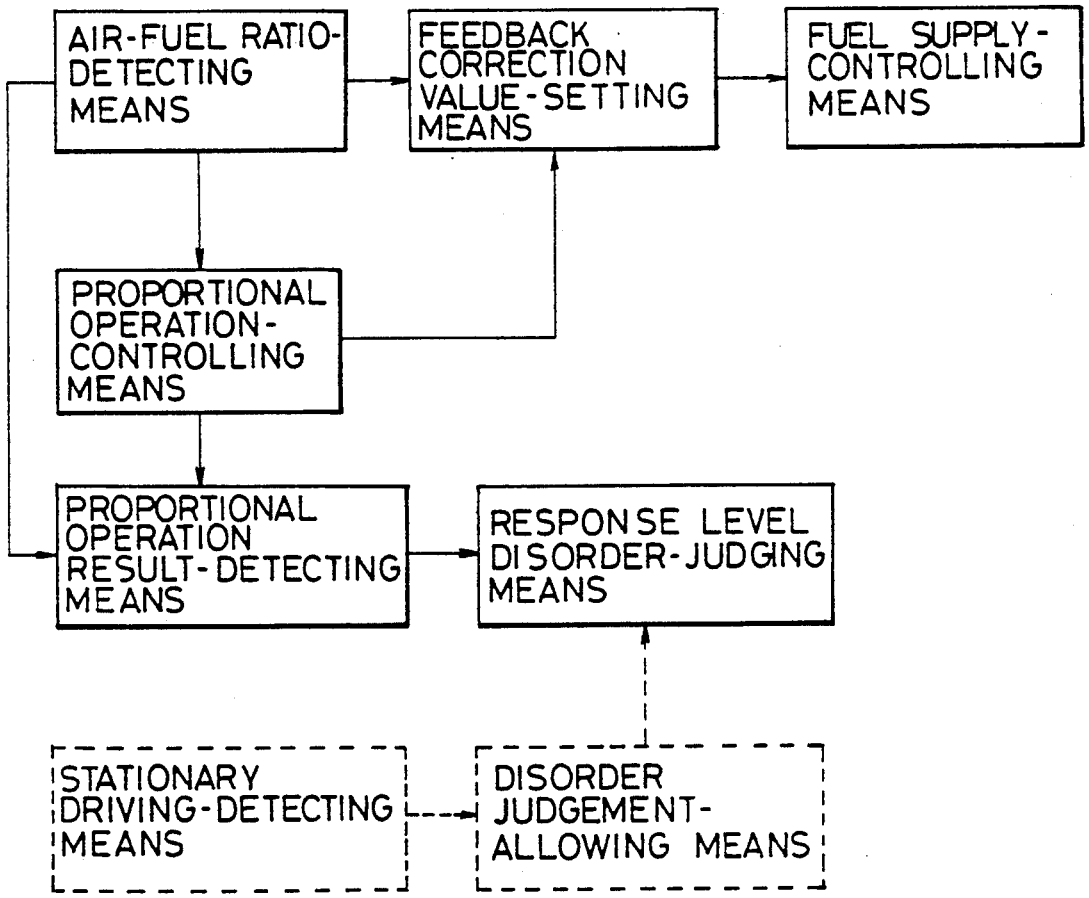
FIGS. 1 through 3 are block diagrams illustrating the structure of the apparatus for the detection and diagnosis of the air-fuel ratio according to the present invention.
Figure 2:
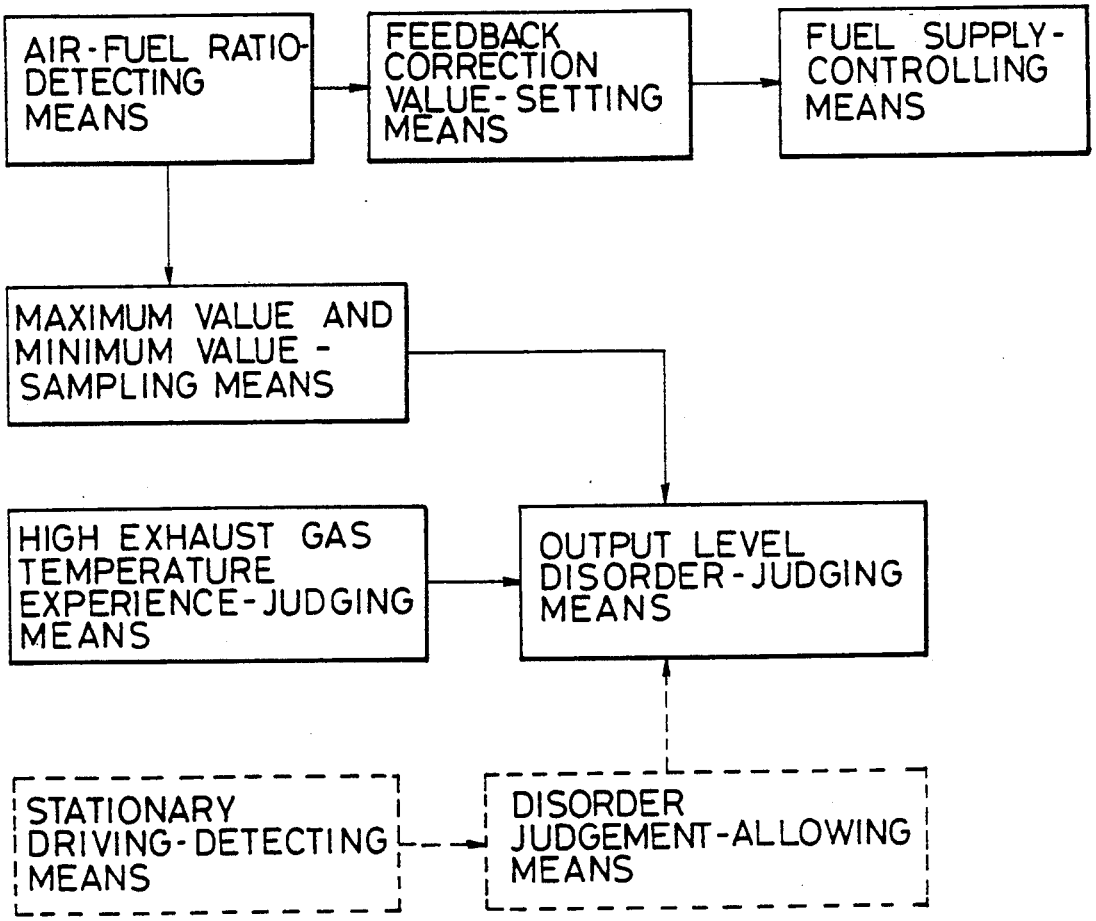
Figure 3:
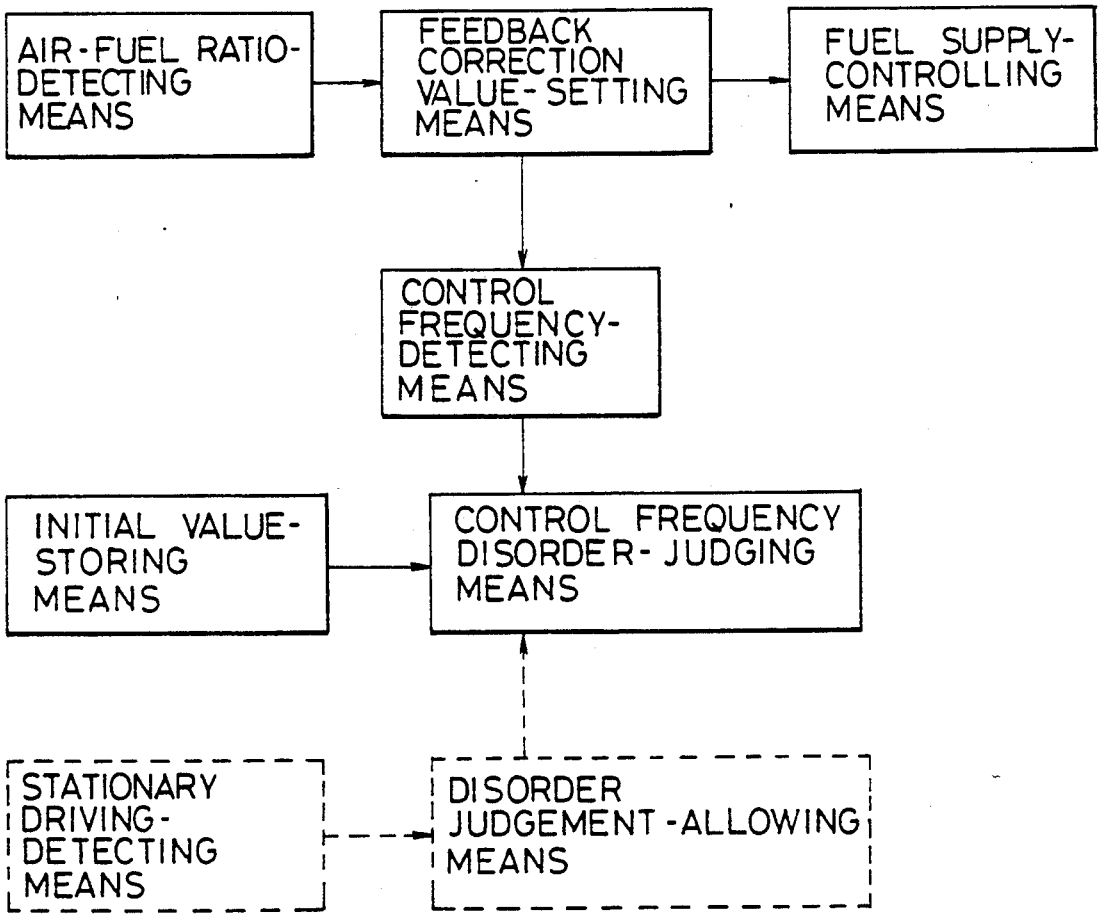

The structure of the apparatus for detecting and diagnosing the air-fuel ratio according to the present invention is illustrated in FIGS. 1 through 3. One embodiment of the apparatus for detecting and diagnosing the air-fuel ratio according to the present invention is illustrated in FIGS. 4 through 17.

Figure 4:
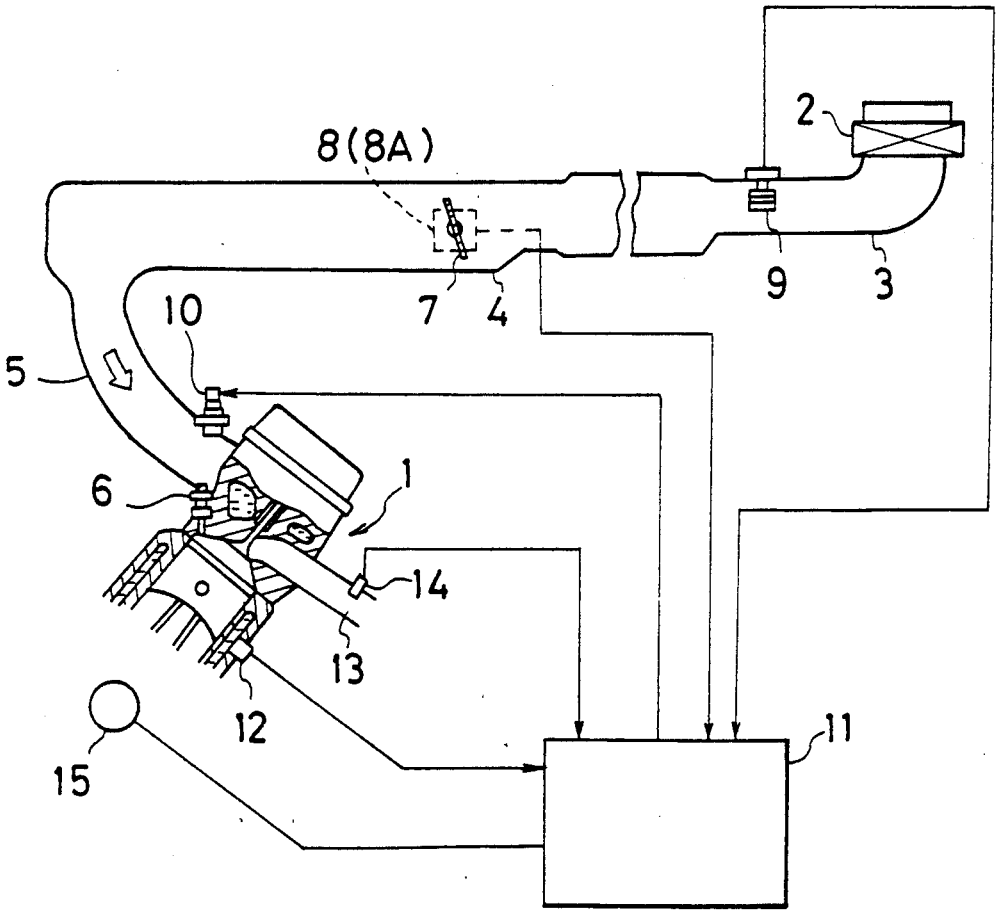
FIG. 4 is a system diagram illustrating one embodiment of the invention.

Referring to FIG. 4 illustrating the system structure of the present embodiment, air is sucked into an internal combustion engine 1 through an air cleaner 2, a suction duct 3, a throttle chamber 4 and a suction manifold 5. A throttle valve 7 variably controlling the open area of the throttle chamber 4 co-operatively with an accelerator pedal not shown in the drawings is arranged in the throttle chamber 4 to control the sucked air flow quantity. A potentiometer detecting the opening degree TVO of the throttle valve 7 and a throttle sensor 8 including an idle switch 8 which is turned on at the fully closed position (idle position) of the throttle valve 7 are attached to the throttle valve 7.

An air flow meter a for detecting the sucked air flow quantity O in the engine 1 is arranged in the suction duct 3 upstream of the throttle valve 7 to emit a voltage signal corresponding to the sucked air flow quantity Q.

An electromagnetic fuel injection valve 10 for each cylinder is arranged in each branch of the suction manifold 5 downstream of the throttle valve 7. The fuel injection valve 10 is opened and driven by a driving pulse signal emitted at a timing synchronous with the revolution of the engine from a control unit 11 having a microcomputer installed therein, and by the fuel injection valve 10, fuel supplied under a pressure from a fuel pump not shown in the drawings and controlled by a pressure regulator to have a predetermined pressure is injected and supplied into the suction manifold 5. Namely, the quantity of the fuel supplied by the fuel injection valve 10 is controlled by the opening and driving time of the fuel injection valve 10.

Furthermore, a water temperature sensor 12 for detecting the cooling water temperature Tw in a cooling jacket of the engine 1 is arranged, and an oxygen sensor 14 is arranged as the air-fuel ratio-detecting means for detecting the air-fuel ratio of an air-fuel mixture sucked in the engine by detecting the oxygen concentration in the exhaust gas in an exhaust path.

The oxygen sensor 14 disclosed is known, for example, in Japanese Unexamined Utility Model publication No. 63-51273. In this sensor, an exhaust gas having a low oxygen concentration is introduced into the outer side of a zirconium tube while open air is introduced into the inner side of the tube, and by utilizing the characteristic phenomenon that the oxygen concentration ratio between the inner and outer sides is changed according to the oxygen concentration in the exhaust gas and on the side richer than the theoretical air-fuel ratio, in which the amount of oxygen is insufficient, the oxygen concentration ratio is high and an eleotromotive force (voltage) $VO_2$ is generated while on the side leaner than the theoretical air-fuel ratio, in which the amount is excessive, the oxygen concentration ratio is low and no substantial electromotive force $VO_2$ is generated, it is judged whether the actual air-fuel ratio is rich or lean as compared with the theoretical air-fuel ratio. The sensor element is not limited to one composed of zirconia, nor is the element structure limited to the tube type structure described above.

An ignition plug 6 is arranged and exposed to a combustion chamber of each cylinder.

The control unit 11 detects the revolution number N of the engine by counting crank unit angle signals POS emitted synchronously with the revolution of the engine from a crank angle sensor 15 or measuring the frequency of crank reference angle signals REF emitted at every predetermined crank angle position (every 180° in case of a four-cylinder engine).

The control of the fuel supply and the control of the diagnosis of a disorder in the oxygen sensor 14 (air-fuel ratio-detecting means) performed by the control unit will now be described with reference to a timing chart of FIG. 11 according to programs shown in the flow charts of FIGS. 5 through 10.

The functions of feedback correction value-setting means, fuel supply-controlling means, proportional operation-controlling means, proportional operation result-detecting means, response level disorder-judging means, maximum value-sampling and minimum value-sampling means, high exhaust gas temperature experience-judging means, output level disorder-judging means, control frequency-detecting means, control frequency disorder-judging means and disorder judgment-allowing means in the present embodiment of the apparatus for the detection and diagnosis of the air-fuel ratio according to the present invention are arranged as software as shown in FIGS. 5 through 10.

The throttle sensor 8 corresponds to the stationary driving-detecting means and the ROM of the microcomputer installed in the control unit 11 corresponds to the initial value-storing means.

Figures 1, 5:
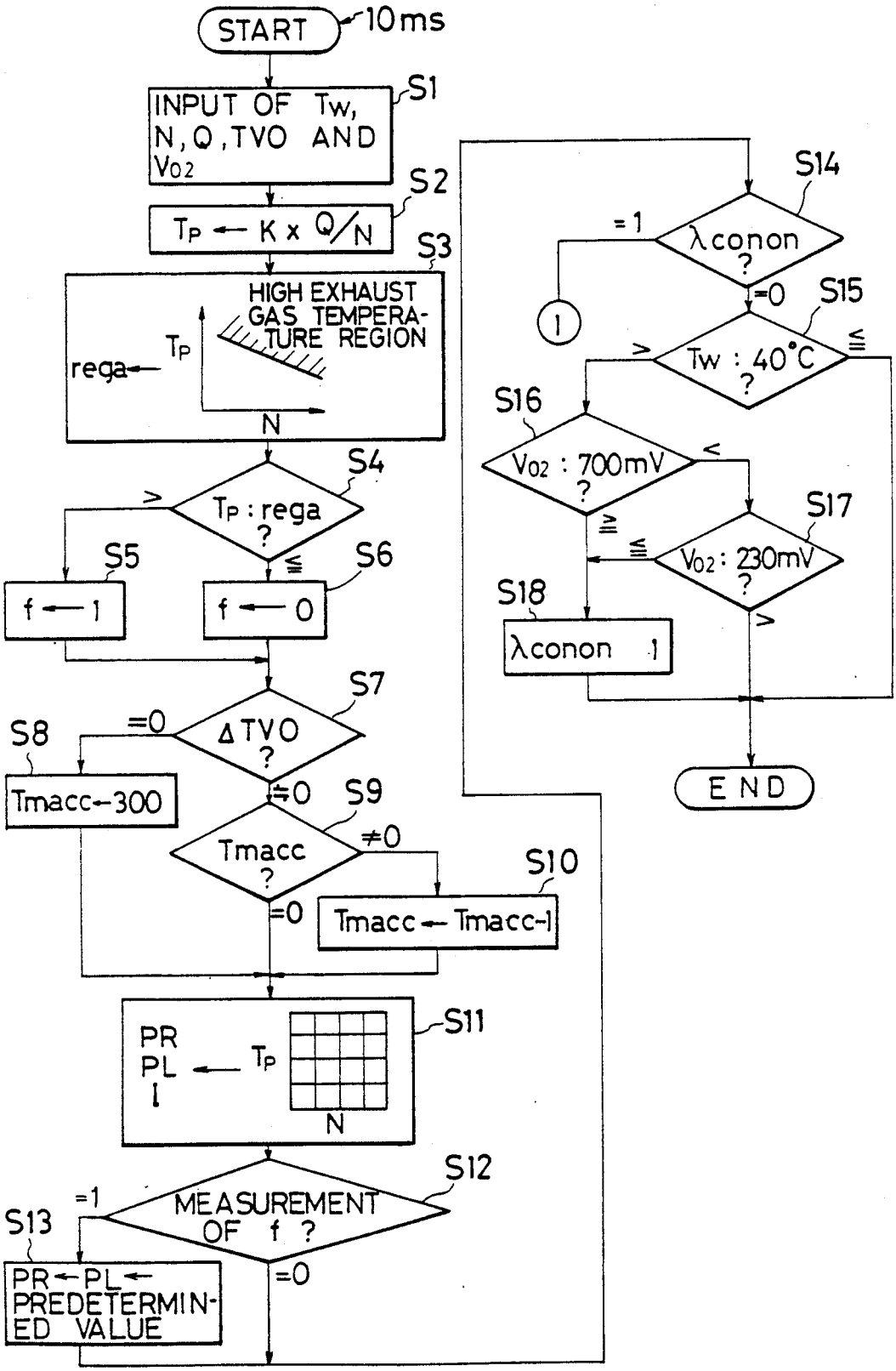
Figures 2, 5:
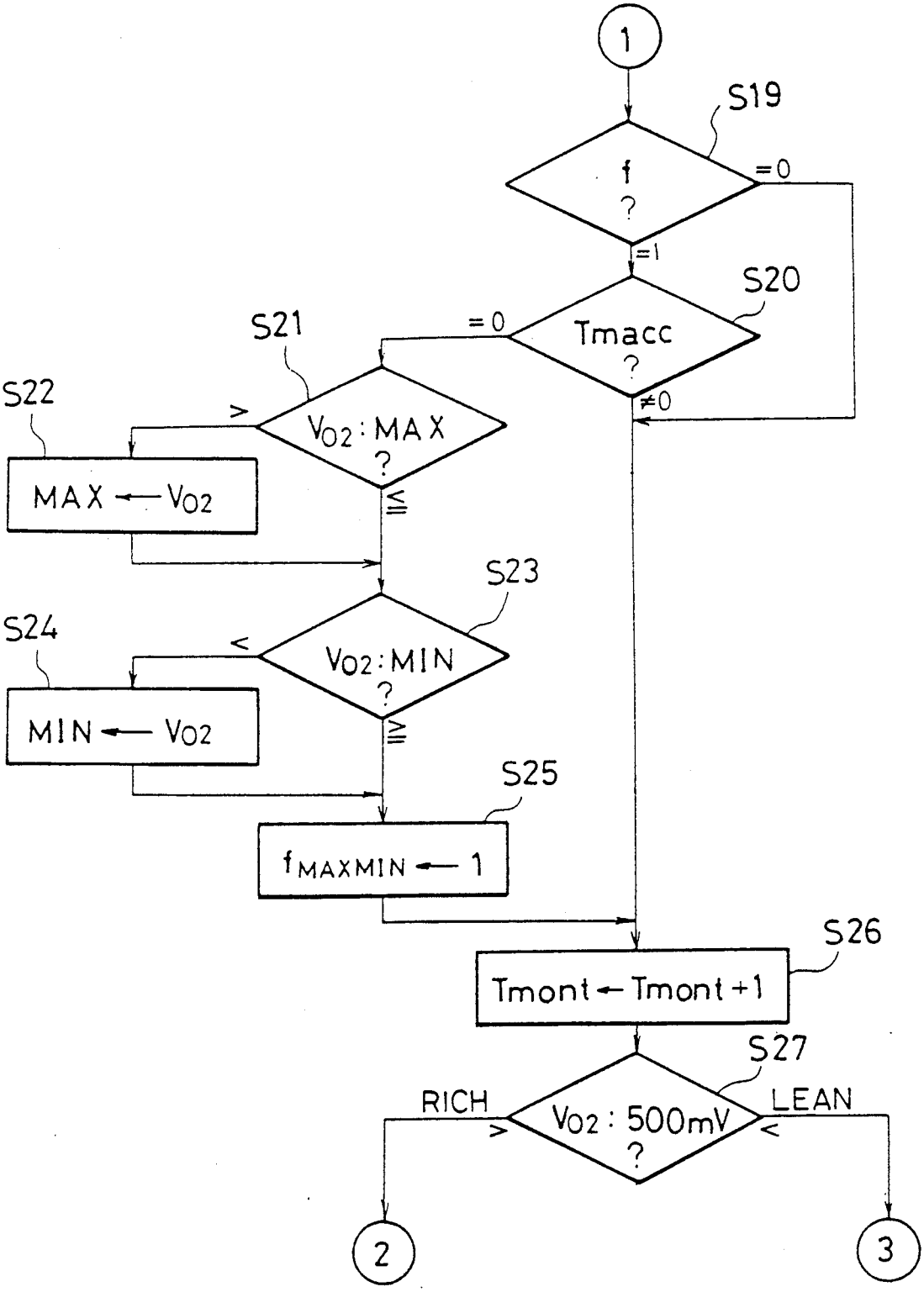
Figures 3, 5:
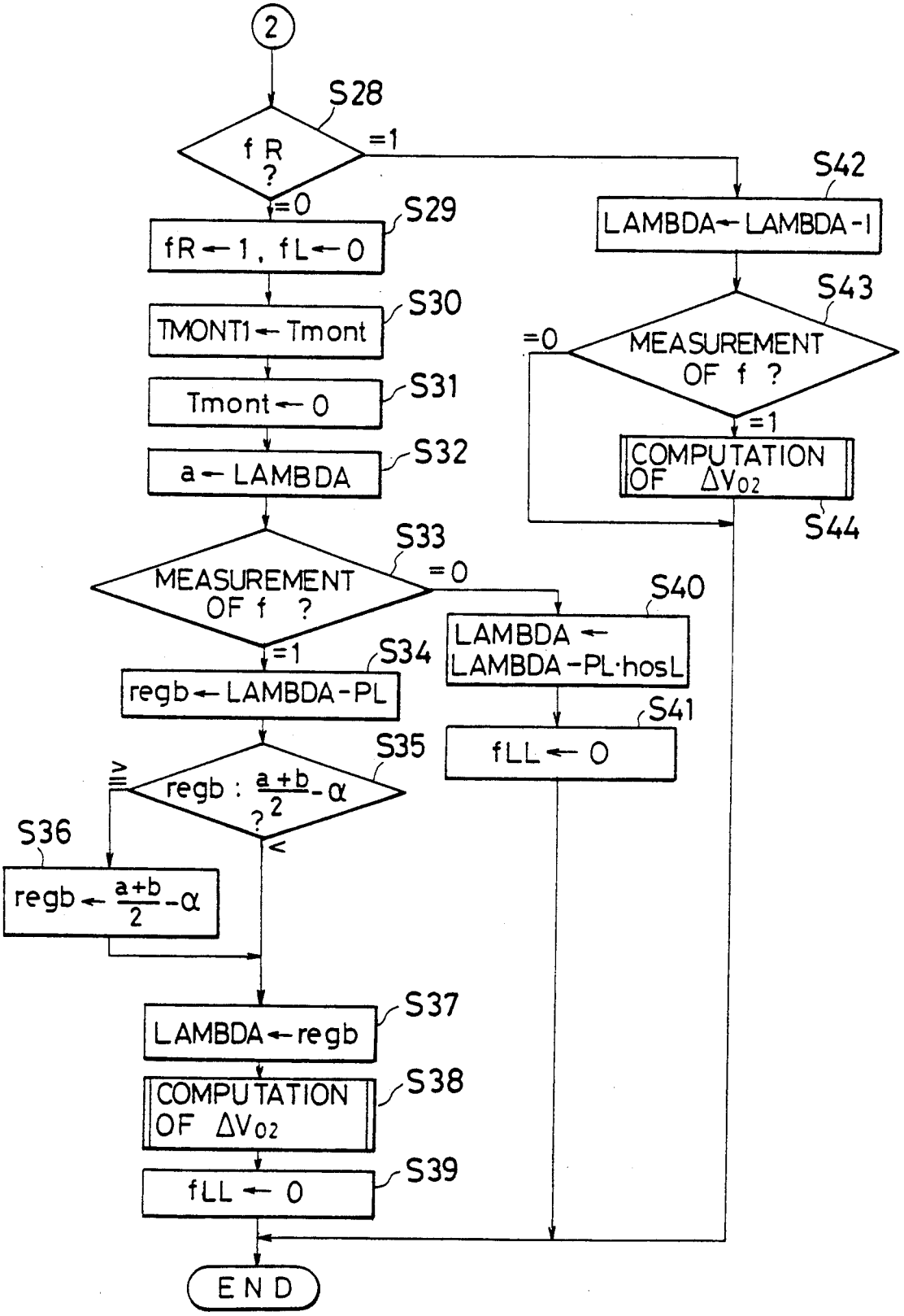
Figures 4, 5:
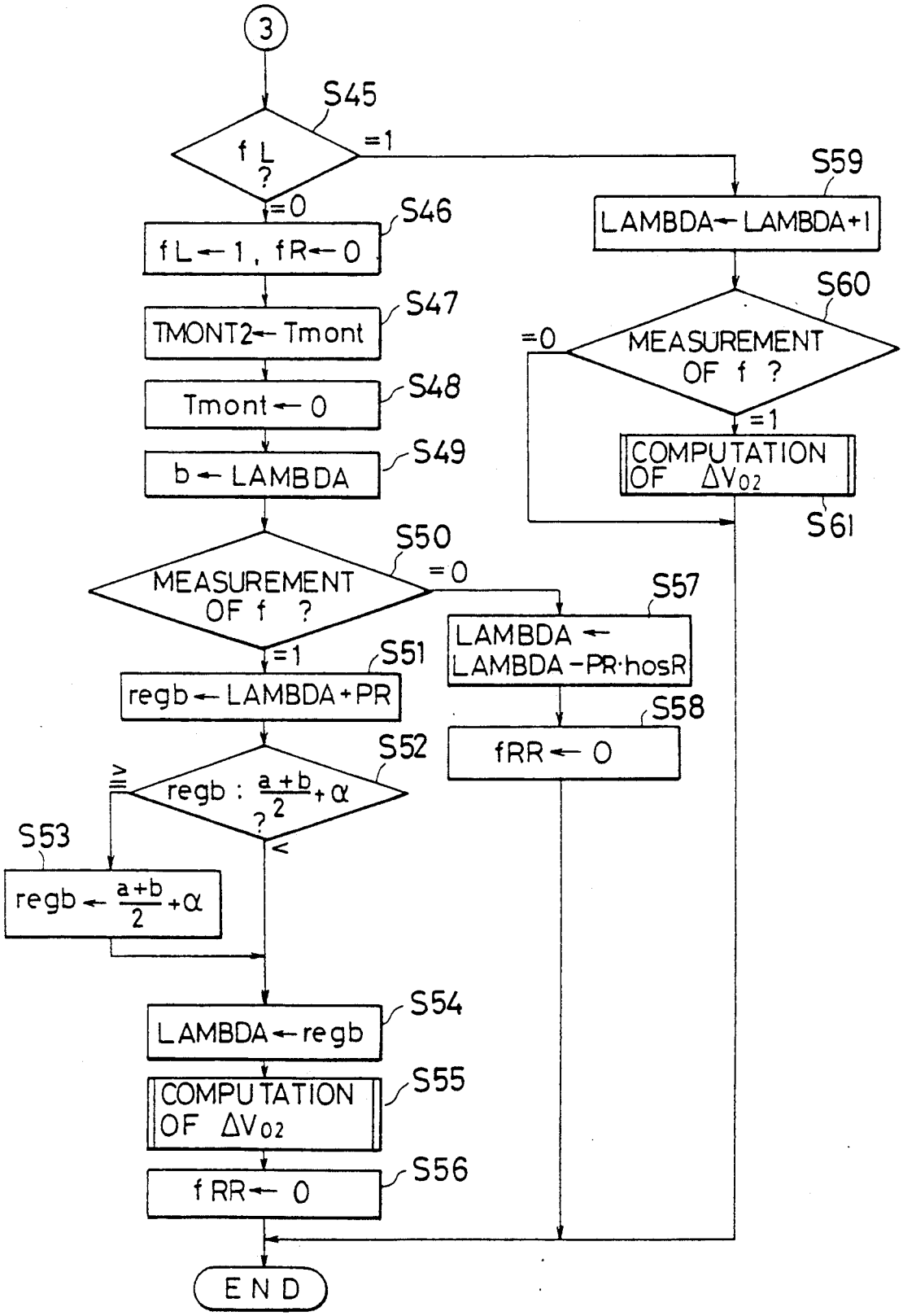

The program shown in the flow chart of FIG. 5 is practiced every 10 ms, and according to this program, the air-fuel ratio feedback correction coefficient (feedback correction value) LAMBDA for feedback control of the actual air-fuel ratio to the target air-fuel ratio (theoretical air-fuel ratio) is set by proportional-integral control.

At first, at step 1 (shown as S1 in the drawings; subsequent steps are similarly shown), detection signals from the respective sensors are received.

At step 2, the basic fuel injection quantity Tp←K×QN; K is a constant) is computed based on the sucked air flow quantity Q and the engine revolution number N.

At step 3, the data corresponding to the present engine revolution number N is retrieved from a map in which basic fuel injection quantities Tp for judging a predetermined high exhaust gas temperature region are stored in correspondence to engine revolution numbers N, and the retrieved basic fuel injection quantity Tp for the judgment is set at rega.

At step 4, the basic fuel injection quantity Tp for the judgment, set at rega, is compared with the basic fuel injection quantity, and it is judged whether or not the present driving condition is in the predetermined high exhaust gas temperature region.

When the basic fuel injection quantity Tp computed based on the present driving condition is larger than the fuel injection quantity Tp for the judgment, set at rega, the present driving condition is in the predetermined high exhaust gas temperature region, and hence, the routine goes into step 5 and 1 is set at a flag f for sequentially judging the occurrence of the predetermined high exhaust gas temperature region and by this flag f, it is judged that the predetermined high exhaust gas temperature region has occurred.

On the other hand, when the basic fuel injection quantity Tp is smaller than the basic fuel injection quantity Tp for the judgment, set at rega, the driving condition is not in the predetermined high exhaust gas temperature region, and hence, the routine goes into step 6 and zero is set at flag f. By this flag f, it is judged that the high exhaust gas temperature region has not been experienced.

At step 7, it is judged whether or not the change quantity ΔTVO of the opening degree TVO of the throttle valve 7 detected by the throttle sensor 8 is substantially zero, whereby it is judged whether or not the engine 1 is in the stationary driving state.

When the change quantity ΔTVO is not substantially zero, the engine 1 is in the transient driving state, and at this time, the routine goes into step 8 and a predetermined value (for example, 300) is at a timer value Tmacc for measuring the lapse of time from the change to stationary driving from transient driving. On the other hand, when the above-mentioned change quantity ΔTVO is substantially zero, the engine is in the stationary driving state, and at this time, the routine goes into step 9 and it is judged whether or not the timer value Tmacc is zero. When the timer value Tmacc is not zero, the routine goes into step 10 and 1 is subtracted from the timer value Tmacc.

Accordingly, when the engine is in the transient driving state, the predetermined value is set at the timer Tmacc, and if the driving state is shifted to the stationary state, is subtracted from the timer value Tmacc every time this program is practiced. If the time defined by the above-mentioned predetermined value elapses from the point of shifting to stationary driving, the timer value Tmacc becomes zero, and hence, the stable stationary driving state, which is not just after the transient driving state, is judged.

At step 11, the operation quantity in the proportional-integral control is retrieved and determined from a map in which the engine revolution number N and the basic fuel injection quantity Tp are preliminarily set as parameters. The operation quantity retrieved at this step is used for the proportional-integral control of the air-fuel ratio feedback correction coefficient LAMBDA (feedback correction value), and the proportional component pR of the rich control for increasing the air-fuel ratio feedback correction coefficient LAMBDA by proportional operation when the rich air-fuel ratio is reversed to a lean air-fuel ratio, the proportional component PL of the lean control for decreasing the feedback correction coefficient LAMBDA by the proportional control when the lean air-fuel ratio is reversed to a rich air-fuel ratio, and the integral portion I for the integral control operation of the air-fuel ratio feedback correction coefficient LAMBDA are set at this step.

At step 12, the judgment of measurement of the flag f for the changeover selection as to whether or not the diagnosis of deterioration of the oxygen sensor should be performed is carried out. The measurement of the flag f is such that if the flag f is at 1, the diagnosis of deterioration of the oxygen sensor 14 is selected, and if the flag f is at zero, the diagnosis of deterioration of the oxygen sensor 14 is canceled. If the flag f is measured to be at 1, in the proportional-integral control of the correction coefficient LAMBDA, it is necessary that the response level of the oxygen sensor 14 should be detected by carrying out the lean control and rich control under the same condition. Accordingly, if the flag f is measured to be at 1, the routine goes into step 13, the same predetermined value is adopted for PR and PL instead of the rich control proportional component PR and lean control proportional component PL retrieved at step On the other hand, if at step 12 the flag f is measured to be at zero, the diagnosis of deterioration of the oxygen sensor 14 is not carried out, and hence, the rich control proportional component PR and lean control proportional component PL retrieved at step 11 are used. Incidentally, in the present embodiment, the changeover of setting of the measurement of the flag f is performed such that the changeover between the diagnosis of deterioration of the oxygen sensor 14 and the normal control is effected at a predetermined time interval, as described in detail hereinafter.

At next step 14, the judgment of an initial condition-judging flag λconon at which I is set when all of the initial conditions for initiating the feedback control of the air-fuel ratio are satisfied. According to the program shown in the flow chart of FIG. 9, zero is set at the flag λconon when the ignition switch (IG/SW) is turned on, that is, when electric power is supplied to the control unit 11 (see step 163). The feedback control of the air-fuel ratio is not performed unless 1 is set at this flag λconon.

When it is judged that at step 14 that the flag λconon is at zero, the initial condition is not satisfied yet and the feedback control is not started, and therefore, the routine goes into step 15 and subsequent steps and the attainment of the initial condition is confirmed.

At step 15, the cooling water temperature Tw detected by the water temperature sensor 12 is compared with a predetermined temperature (for example, 40° C.), and in case of the machine-cooled state where the cooling water temperature is lower than the predetermined temperature, the present program is ended and the flag f λconon is kept at zero.

On the other hand, in the case where the cooling water temperature Tw exceeds the predetermined temperature, the routine goes into step 16 and subsequent steps, and it is judged whether or not the oxygen sensor is in the active state capable of emitting a voltage required for detecting the actual air-fuel ratio.

At step 16, the output voltage $VO_2$ of the oxygen sensor 14 is compared with a predetermined voltage (for example, 700 mV) on the rich side, and it is judged whether or not the oxygen sensor 14 puts out a voltage sufficient to judge the rich state. When the output voltage $VO_2$ is higher than the above-mentioned predetermined voltage, it is confirmed that at least the voltage $VO_2$ on the rich side is put out from the oxygen sensor 14, and it is presumed that a normal output should naturally be emitted also on the lean side. Accordingly, the routine goes into step 18 and 1 is set at the flag λconon so that at the next execution, the setting control of the air-fuel ratio feedback correction coefficient LAMBDA will be carried out.

When the output voltage $VO_2$ on the rich side is not sufficiently emitted, the routine goes into step 17, and the output voltage is compared with a predetermined voltage (for example, 239 mV) on the lean side and it is similarly judged whether or not the oxygen sensor 14 can emit a voltage sufficient to judge the lean state. Also at this step, when a voltage lower than the predetermined voltage is put out from the oxygen sensor 14, it is judged that the output voltage can be used for the detection of the air-fuel ratio, and the routine goes into step 18 and 1 is set at the flag λconon.

When the output voltage $VO_2$ is only a voltage near the slice level voltage (for example, 500 mV) even though the cooling water temperature is higher than the predetermined temperature, the present program is ended while keeping the flag λconon at zero.

If 1 is thus set at the flag λconon and the initial condition for starting the feedback control is confirmed the routine goes into step 19 from step 14.

At step 19, the state of the flag f is judged, and when the flag f is at 1 and the driving state is in the predetermined high exhaust gas temperature region, the routine goes into step 20.

At step 20, it is judged whether or not the timer value Tmacc is zero, and if the timer value Tmacc is zero, the routine goes into step 21.

At step 21, the set maximum output value MAX of the oxygen sensor 14 is compared with the present output voltage $VO_2$ of the oxygen sensor 14, and if the present output value is larger than MAX heretofore set, the routine goes into step 22, the present output value is set as MAX to effect renewal setting of MAX.

At step 23, the set minimum output value MIN of the oxygen sensor 14 is compared with the present output Voltage $VO_2$ of the oxygen sensor 14, and if the present output value is smaller than MIN, the routine goes into step 24 and the present output value is set as MIN to effect renewal setting of MIN.

Figure 9:
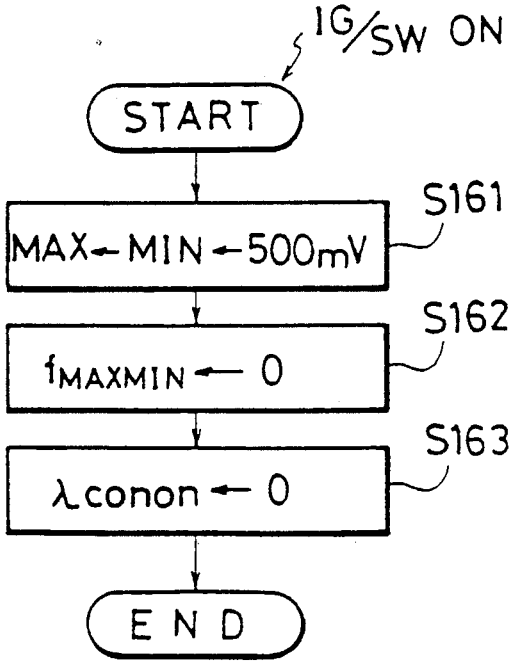

Incidentally, since the above-mentioned maximum value MAX and minimum value MIN are set substantially at the center (500 mV) of the range of the slice level output corresponding to the theoretical air-fuel ratio at the time of turning-on the ignition switch according to the program shown in the flow chart of FIG. 9 (see step 161), the values MAX and MIN are renewed in succession in the predetermined high exhaust gas temperature region and the maximUm value MAX and minimum value MIN attained when the driving state is in the predetermined high exhaust gas temperature range and the engine is in the stationary driving state are sampled.

At next step 25, 1 is set at a flag fmaximin for judging whether or not the high exhaust gas temperature region has occurred. Since zero is set at the flag fmaxmin when the ignition switch is turned on according to the program shown in the flow chart of FIG. 9 (see step 162), when the driving state is in the predetermined exhaust gas temperature region and the engine is stationary driven and when the routine goes into step 21, 1 is first set at the flag fmaxmin.

When it is judged at step 19 that the flag f is at zero and the driving state is not in the high exhaust gas temperature region, if the engine 1 is in the transient driving state where it is judged that the timer value Tmacc is not at zero, the routine goes into step 26 while skipping over steps 21 through 25.

At step 26, a timer value Tmont which is reset at zero at the first rich/lean reversal of the air-fuel ratio relative to the target air-fuel ratio is increased by 1, so that the elasped time from the reversal of the air-fuel ratio can be measured by this timer value Tmont.

At next step 27, the slice level voltage (for example, 500 mV) corresponding to the theoretical air-fuel ratio, that is, the target air-fuel ratio, which is almost the median of the ordinary output voltage range of the oxygen sensor, is compared with the output voltage $VO_2$ of the oxygen sensor 14, and it is judged whether the actual air-fuel ratio is rich or lean as compared with the theoretical air-fuel ratio.

When the output voltage $VO_2$ is higher than the slice level voltage, the actual air-fuel ratio is richer than the target air-fuel ratio, and the routine goes into step 28.

At step 28, based on the flag FR, it is judged whether or not this judgment of the rich air-fuel ratio is the first judgment. As described hereinafter, zero is set at this flag fR at the first detection of the lean air-fuel ratio, and therefore, if the present detection of the rich air-fuel ratio is the first detection of the rich air-fuel ratio, it is judged that the flag fR is at zero, and the routine goes into step 29.

At step 29, 1 is set at the flag fR and zero is set at a flag fL for judgment of the first detection of the lean air-fuel ratio described hereinafter.

At step 30, the timer value Tmont which has been reset at zero at the first detection of the lean air-fuel ratio as described hereinafter and then counted up during the detection of the lean air-fuel ratio is set at TMONT1 indicating the time of the lean state.

At step 32, the present value of the air-fuel ratio feedback correction coefficient LAMBDA is set as maximum value a. Since it has been judged at the preceding cycles that the air-fuel ratio is lean and the air-fuel ratio has been increased, at the present detection of the rich air-fuel ratio, control for decreasing the air-fuel ratio is started, and hence the air-fuel ratio feedback correction coefficient LAMBDA just before the start of control for decreasing the air-fuel ratio at the first detection of the rich air-fuel ratio is the maximum value.

At next step 33, the result of the measurement of the flag f is judged, and if the flag f is measured to be at zero and the normal feedback control is carried out, the routine goes into step 40, and a correction value obtained by multiplying the proportional component pL of the lean control by the lean control correction coefficient hosL is subtracted from the preceding air-fuel ratio feedback correction coefficient LAMBDA to decrease the correction coefficient LAMBDA by the proportional operation and set the obtained result as the new correction coefficient LAMBDA.

At next step 41, an initial decrease-judging flag fL used at the diagnosis of deterioration of the oxygen sensor 14 is reset at zero, and the routine is ended.

On the other hand, when it is judged at step 33 that the flag f is measured to be at 1, the routine goes into step 34 and subsequent steps, and processing for the diagnosis of deterioration of the oxygen sensor 14 is carried out.

At step 34, the proportional component PL of the lean control, which is set at the same predetermined value as that of the proportional component PR of the rich control at step 13, is subtracted from the preceding air-fuel ratio feedback correction coefficient LAMBDA to decrease the correction coefficient LAMBDA by the proportional operation and set the obtained correction coefficient LAMBDA at regb.

At the next step 35, a value obtained by subtracting a fixed value from the average value (median) of the correction coefficient LAMBDA obtained as the average value of the maximum value of the correction coefficient LAMBDA obtained at present step 32 and the minimum value b is compared with regb obtained at step 34. If it is judged that regb is larger, the routine goes into step 36, and regb is renewed and $[(a+b)/2-\alpha]$ is set as a new regb and the routine goes into step 37.

On the other hand, when it is judged at step 35 that regb is smaller, the routine goes into step 37. At step 37, the correction coefficient LAMBDA set at regb is set as the correction coefficient LAMBDA finally used for the correction of the fuel quantity.

The air-fuel ratio feedback correction coefficient LAMBDA is set for controlling the mean air-fuel ratio to the target air-fuel ratio by causing the actual air-fuel ratio to vary with the target air-fuel ratio being the center by the proportional-integral control based on the result of the judgment as to whether the actual air-fuel ratio is rich or lean relative to the target air-fuel ratio. Accordingly, the air-fuel ratio feedback correction coefficient LAMBDA is the correction coefficient necessary for this mean air-fuel ratio to become the target air-fuel ratio. Since the reversal of the air-fuel ratio to the rich side is now detected, it is necessary to decrease the fuel supply quantity by decreasing the air-fuel ratio feedback correction coefficient. Practically, if the air-fuel ratio feedback correction coefficient LAMBDA is controlled to a value smaller than $[(a+b)/2]$ corresponding to the target air-fuel ratio, at least the rich state of the air-fuel ratio should be cancelled.

However, even if the proportional control of the air-fuel ratio feedback correction coefficient LAMBDA is performed based on the preliminary set proportional component of the lean control, the proportional control sufficient to cancel the rich state is not always accomplished, and the time required for cancelling the rich state differs under the same driving condition according to the application level of the proportional control. In the present embodiment, the time from the execution of the proportional control of the correction coefficient LAMBDA at the reversal of the air-fuel ratio to the actual start of the change of the actually detected air-fuel ratio toward the target air-fuel ratio is measured for the diagnosis of deterioration of the oxygen sensor 14. Accordingly, in order to realize the same condition, the air-fuel ratio feedback correction coefficient LAMBDA is set so that at least the present rich state of the air-fuel ratio can be canceled.

Figure 6:
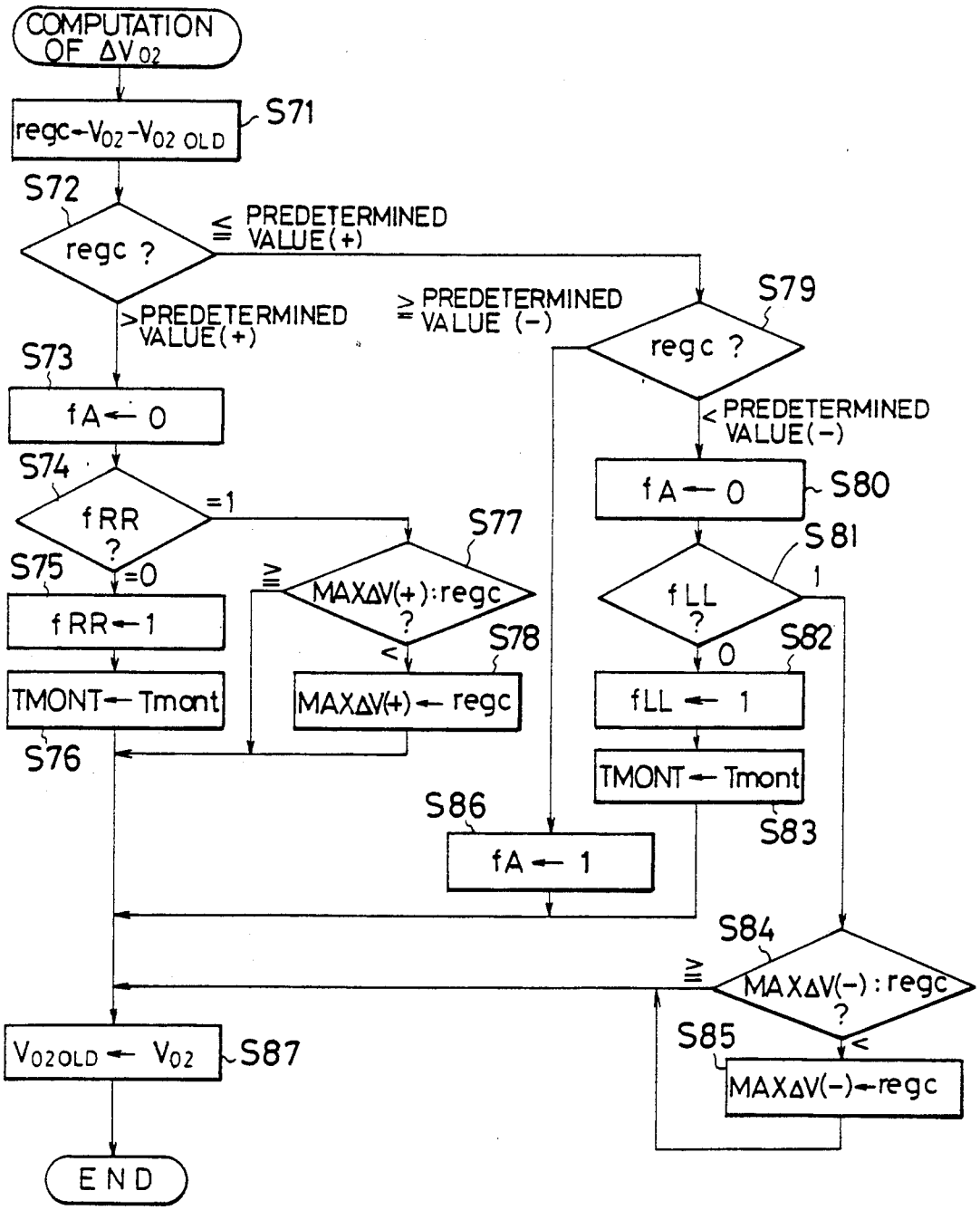

At next step 38, the change quantity $\Delta VO_2$ of the output voltage $VO_2$ of the oxygen sensor 14 per unit time is computed as shown in the flow chart of FIG. 6.

At first, at step 71, the change quantity $VO_2$ per unit time (10 ms) is determined by subtracting the output voltage $VO_2$old at the preceding execution (before 10 ms) from the output voltage $VO_2$ of the oxygen sensor 14 received at step 1 at the present execution, and the obtained result is set at regc.

At step 72, the value of regc at which the newest change quantity $\Delta VO_2$ is set is compared with a positive predetermined value (+), and it is judged whether or not the output voltage $VO_2$ of the oxygen sensor 14 increases at a rate exceeding the predetermined level.

If it is judged that regc($\Delta VO_2$) is larger than the predetermined value (+), the routine goes into step 73, and a flag fA for judging whether or not the output voltage $VO_2$ is substantially constant is set at zero, so that the change of the output voltage $VO_2$ can be judged by this flag fA.

At next step 74, the judgment of a flag fRR for judging the initial increase change is performed. As described hereinafter, the initial increase change-judging flag fRR is reset at zero at the initial detection of the lean state, and if it is first detected afterward that the output voltage $VO_2$ increases at a rate exceeding predetermined level, 1 is set at the flag fRR.

Accordingly, when it is judged at step 74 that the flag fRR is at zero, it is indicated that the output voltage $VO_2$ changes in the increasing direction from the initial direction of the lean state. If it is judged at step 74 that the flag fRR is at zero, at step 75, 1 is set at the flag fRR so that it can be judged that the initial detection has been completed. At next step 76, the timer value Tmont which has been reset at zero at the initial detection of the lean state and measures the elapsing time from this initial direction is set at TMONT3. Therefore, TMONT3 indicates the time from the initial detection of the lean state to the start of the change of the air-fuel ratio in the increasing direction toward the rich state.

On the other hand, if it is judged at step 74 that the flag fRR is at the routine goes into step 77, and regc at which the change quantity $\Delta VO_2$ detected at step 71 at the present execution is set is compared with the positive maximum change quantity $\Delta V$ (+). The positive maximum change quantity-$\Delta V$ (+) is reset at zero by the background processing shown in the flow chart of FIG. 7, and the maximum value of the change quantity $\Delta VO_2$ of the output voltage $VO_2$ on the positive side is set. If it is now judged that regc at which $\Delta VO_2$ sampled at the present execution is set is larger than the preceding positive maximum change quantity $\Delta V(+)$, the routine goes into step 78, and regc is renewed and set at $\Delta V(+)$.

Then, at step 87, for computation of the next change quantity $\Delta VO_2$ (regc), the output voltage $VO_2$ received at step 1 at the present execution is set at the precedent value $VO_2$old.

On the other hand, if it is judged at step 72 that regc is smaller than the positive predetermined value, the routine goes into step 79, and the value of regc is compared with the negative predetermined value (−) and it is judged whether or not the output voltage $VO_2$ decreases at a rate exceeding the predetermined level.

If it is judged that regc is smaller than the negative predetermined value (−), the routine goes into step 80, and zero is set at a flag fA for judging whether or not the output voltage $VO_2$ is substantially constant, so that the change of the output voltage $VO_2$ can be judged by this flag fA.

At next step 81, the judgment of a flag fLL for judging the initial decreasing change is performed. As described hereinafter, the initial decreasing change-judging flag fLL is reset at zero, and when it is first detected afterward that the output voltage $VO_2$ decreases at a rate exceeding the predetermined level, 1 is set at the flag fLL.

Accordingly, if it is judged at step 81 that the flag fLL is at zero, it is indicated that the output voltage $VO_2$ decreases in the decreasing direction (toward the lean state) for the first time from the initial direction of the rich state. Accordingly, when it is judged at step 81 that the flag fLL is at zero, at step 82, 1 is set at the flag fLL so that it can be judged that the initial detection has been made. At next step 83, the timer value Tmont which has been reset at zero at the initial detection of the rich state and measures the elapsed time from this initial detection is set at TMONT4. Accordingly, TMONT4 indicates the time from the initial detection of the rich state to the start of the change of the air-fuel ratio to the lean state.

On the other hand, if it is judged at step 81 that the flag fLL is at 1, the routine goes into step 84, and regc at which the change quantity $\Delta VO_2$ detected at the present execution is set is compared with the negative maximum change quantity $\Delta V$ (−). The negative maximum change quantity$\Delta V$ (−) is reset at zero by the background processing shown in the flow chart of FIG. 7, and the maximum value of the change quantity $\Delta VO_2$ of the output voltage $VO_2$ on the negative side is set. If it is now judged that regc at which $\Delta VO_2$ sampled at the present invention is set is smaller than the preceding maximum change quantity $\Delta V$ (−) on the negative side, the routine goes into step 85, and regc is renewed and set at $\Delta V$ (−).

At step 87, the output voltage $VO_2$ received at step 1 at the present execution is set at the preceding value $VO_2$old.

Furthermore, when it is judged at step 79 that regc exceeds the negative predetermined value (−), the output voltage $VO_2$ of the oxygen sensor 14 does not change greatly on both the positive and negative sides but there is no substantial change of the output. Accordingly, 1 is set at the flag fA so that the stable state of the output voltage $VO_2$ can be judged by the flag fA.

Referring to the flow chart of FIG. 5 again, at the initial detection of the rich state where the change quantity $\Delta VO_2$ of the output voltage $VO_2$ of the oxygen sensor 14 is computed in the above-mentioned manner, the flag fLL for judging the initial detection of the decreasing change is reset at zero at step 39, and the time (TMONT4) of from the decrease of the output voltage $VO_2$ of the oxygen sensor 14 on the initial detection of the rich state to the start of the change of the air-fuel ratio toward the lean state is detected.

At the second or subsequent detection of the rich state where it is judged at step 28 that the flag fR is at 1, the integral component I retrieved at step 11 is subtracted from the precendent air-fuel ratio feedback correction coefficient LAMBDA at step 42, and the obtained result is set as a new correction coefficient LAMBDA. At this step 37, the correction coefficient LAMBDA is decreased by the integral component I every 10 ms until the rich state of the air-fuel ratio is canceled.

Then, at step 43, the judgment of the measurement of the flag f is performed, and only when the flag f is measured to be at 1 and the diagnosis of deterioration is carried out, the routine goes into step 44 and the above-mentioned processing shown in the flow chart of FIG. 6 is carried out, whereby sampling of the change quantity $\Delta VO_2$ of the output voltage $VO_2$ of the oxygen sensor 14, sampling of the maximum values of the change quantity $\Delta VO_2$ in both of the positive and negative directions and sampling of times (TMONT3 and TMONT4) of from the initial detection of the rich and lean states to the start of the changes in the directions toward the target air-fuel ratio are effected.

On the other hand, when it is judged at step 27 that the output voltage $VO_2$ of the oxygen sensor 14 is lower than the slice level corresponding to the target air-fuel ratio (theoretical air-fuel ratio) and the air-fuel ratio is lean as compared with the target air-fuel ratio, a computing processing substantially similar to the above-mentioned processing conducted at the detection of the rich air-fuel ratio is carried out. This processing will now be described briefly. Incidentally, the operation illustrated below corresponds to the operation at steps 45 to 61 in the flow chart of FIG. 5.

Namely, at the initial detection of the lean state, the value of Tmont which has been reset at zero at the initial detection of the rich state and measures the elapsing time from this initial detection is set at TMONT2, so that TMONT2 indicates the time of the detection of the rich state.

At the initial detection of the lean state, the air-fuel ratio feedback correction coefficient LAMBDA should be the lower peak value. Accordingly, this peak value is set at b, and from the mean value of this lower peak value and the upper peak value a sampled at the initial direction of the rich detection, the air-fuel ratio feedback correction coefficient LAMBDA corresponding to the target air-fuel ratio is determined and at the time of the diagnosis of deterioration (when the flag f is measured to be at 1), the correction coefficient LAMBDA larger than this value corresponding to the target air-fuel ratio is set by the proportional control, whereby the correction coefficient LAMBDA capable of substantially cancelling the lean state by the proportional control at the initial detection of the lean state can be set.

At the second or subsequent detection of the lean state, the air-fuel ratio feedback correction coefficient LAMBDA is increased by addition of the integral component I, and the increasing correction by the integral component I is continued untiL the lean state is cancelled and the air-fuel ratio is reversed to a rich side.

At the diagnosis of deterioration, the change quantity $\Delta VO_2$ of the output voltage $VO_2$ is computed as shown in the flow chart of FIG. 6, and computation of the maximum change quantity and sampling of the time from the initial detection of the lean state to the start of the change of the air-fuel ratio toward the rich side (TMONT3) are carried out.

Figures 1, 7:
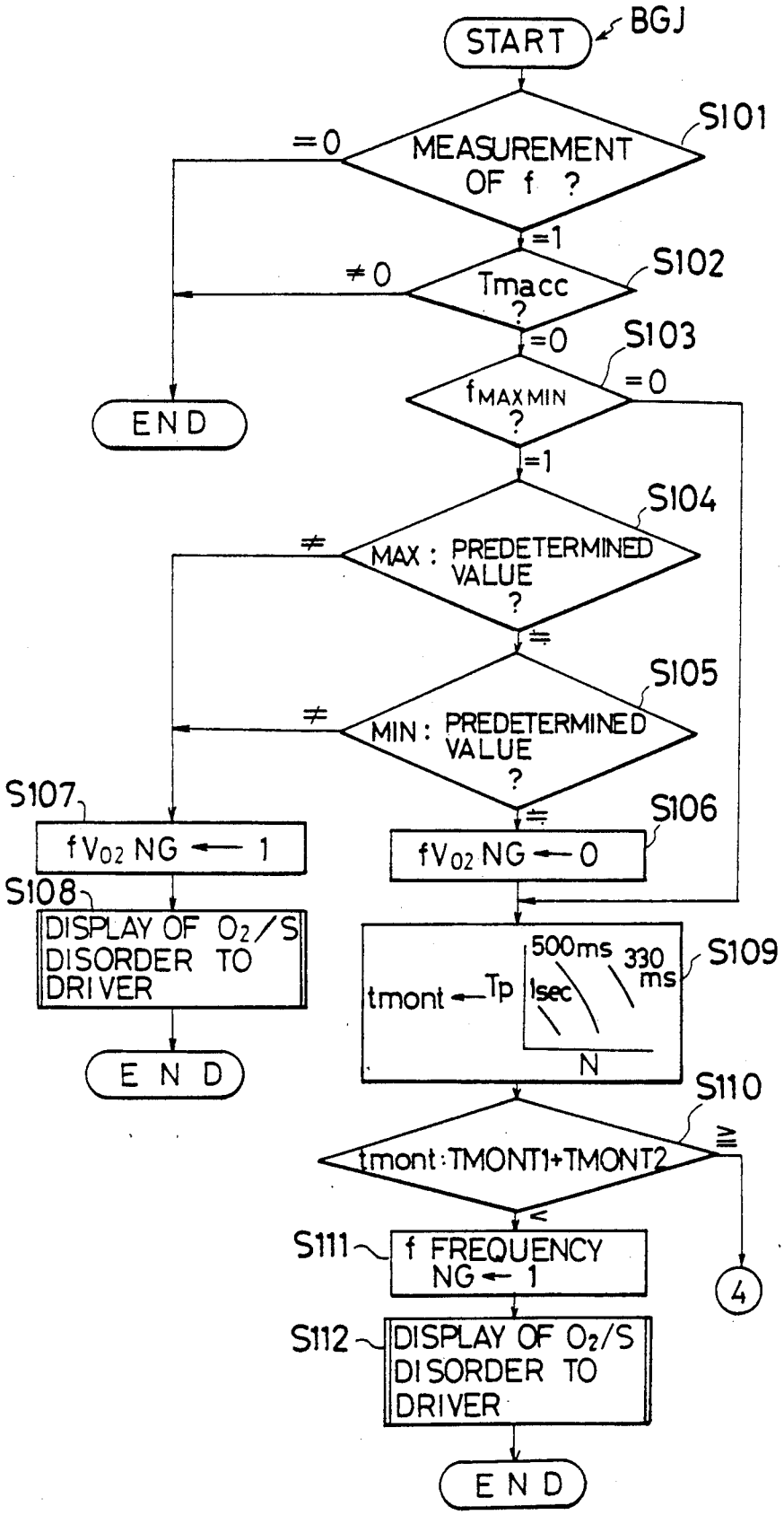
Figures 2, 7:
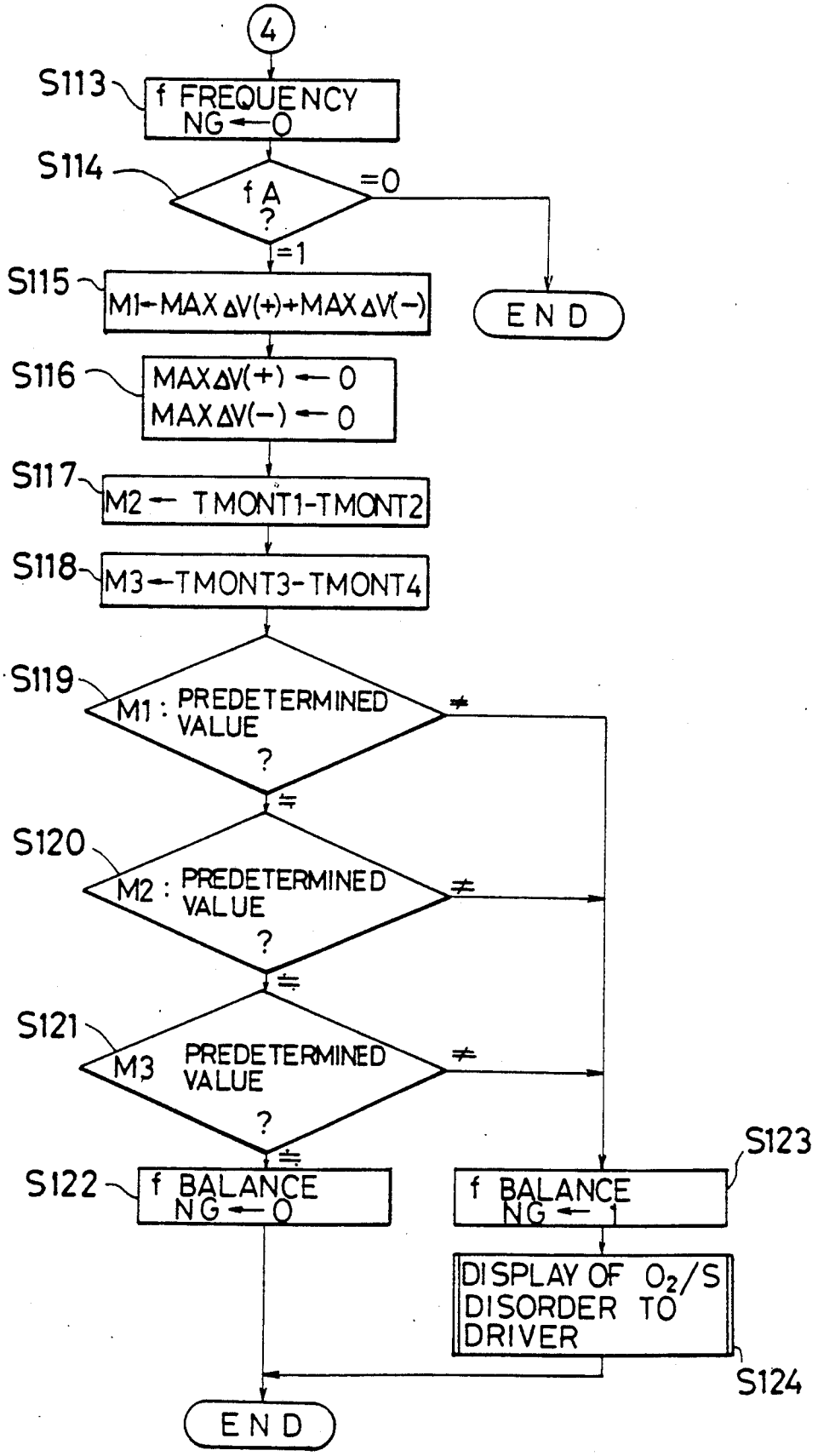

The program of the diagnosis of the oxygen sensor 14, shown in the flow chart of FIG. 7, will now be described. This program is conducted by the background processing. At first, at step 101, the measurement of the flag f is judged, and only when the flag 1 is measured to be at 1, is the processing at step 102 and subsequent steps carried out.

At step 102, the timer value Tmacc is judged, and only when the timer value Tmacc is zero and the engine is in the stable stationary driving state, is the following computing processing performed. The reason is that the following disadvantage should be avoided. Namely, in the transient driving state of the engine, the air-fuel ratio is rendered extremely lean or rich by the response delay of the liquid fuel supplied along the wall surface of the suction path, and the control state of the air-fuel ratio feedback correction coefficient based on this change of the air-fuel ratio is sampled, resulting in an erroneous diagnosis of deterioration of the oxygen sensor 14. Therefore, the computation processing is effected only in the stationary driving state.

When the timer value Tmacc is zero, the routine goes into step 103 and the judgment of the flag fmaxmin is performed. As pointed out hereinbefore, the flag fmaxmin is reset at zero when the ignition switch is turned on, and when the predetermined high exhaust gas temperature region then occurs, 1 is set at the flag fmaxmin. In the predetermined high exhaust gas temperature region, the maximum value MAX and minimum value MIN of the output voltage $VO_2$ of the oxygen sensor 14 are sampled, and therefore, the routine goes into step 104 and subsequent steps and it is judged whether or not the initial values are sampled as the maximum value MAX and minimum value MIN. Disorder or deterioration of the oxygen sensor 14 is diagnosed based on the result of this judgment.

Figure 12:
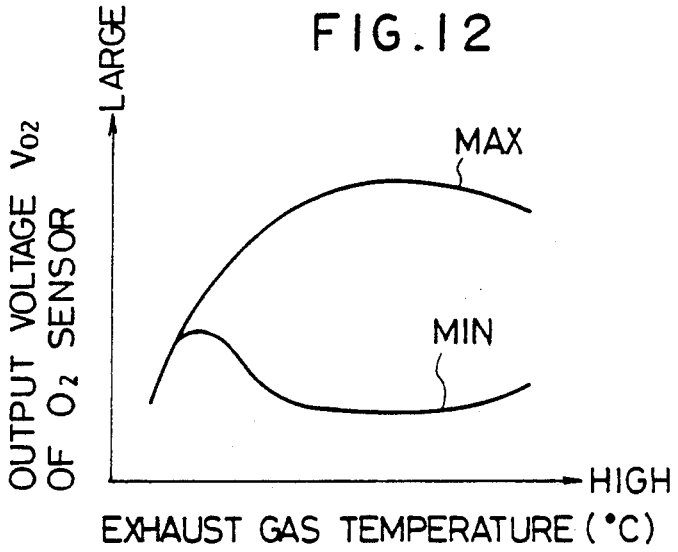
FIG. 12 is a graph illustrating the relation between the exhaust gas temperature and the output voltage of an oxygen sensor.

Since the output of the oxygen sensor 14 is as shown in FIG. 12, if the exhaust gas temperature exceeds the predetermined level, maximum and minimum values of substantially constant levels are put out according to the rich and lean states of the air fuel ratio, if such maximum and minimum values in the initial state are stored, by comparing these initial values with the detected maximum and minimum values, a disorder of the output level of the oxygen sensor 14 can be judged.

Accordingly, at step 104, the maximum value MAX sampled in the predetermined high exhaust gas temperature region is compared with the predetermined value (initial value) corresponding to the maximum value in the initial state, and when the sampled maximum value MAX is not substantially equal to the initial value, the routine goes into step 107, and 1 is set at a flag $fVO_2NG$ for judging a disorder of the output level of the oxygen sensor 14, so that a disorder of the output level of the oxygen sensor 14 can be judged by the flag $fVO_2NG$.

Then, at step 108, occurrence of any disorder in the oxygen sensor 14 is indicated to a driver by a display on a dashboard of the vehicle or the like.

When it is judged at step 104 that the maximum value MAX is substantially equal to the initial value, at step 5 the sampled minimum value MIN is compared with the initial minimum value. When the maximum value MAX is different from the initial value, the routine goes into step 107 as in the case where the maximum value MAX is different from the initial value, I is set at the flag $fVO_2NG$, and the driver is informed of the occurrence of a disorder in the oxygen sensor 14.

On the other hand, when it is judged that both of the maximum value MAX and minimum value MIN are substantially equal to the initial values, zero is set at the flag $fVO_2NG$ at step 106, so that it can be judged by this flag $fVO_2NG$ that at least with respect to the output level of the oxygen sensor 14, no disorder occurs.

Figure 13:
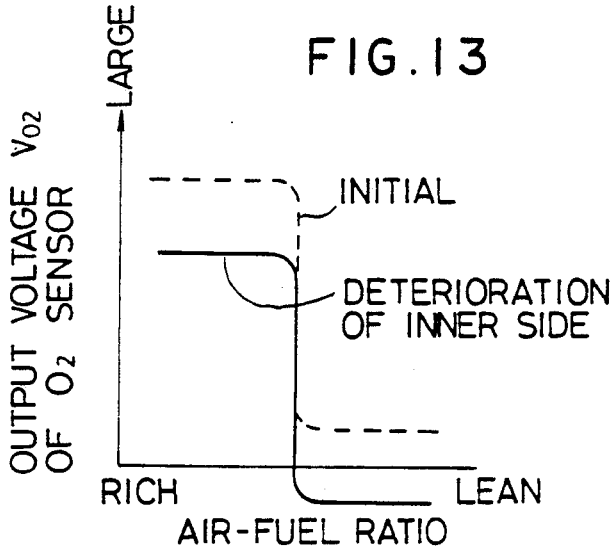
FIG. 13 is a graph illustrating changes of output characteristics caused when an inner electrode of the oxygen sensor is deteriorated.
Figure 14:
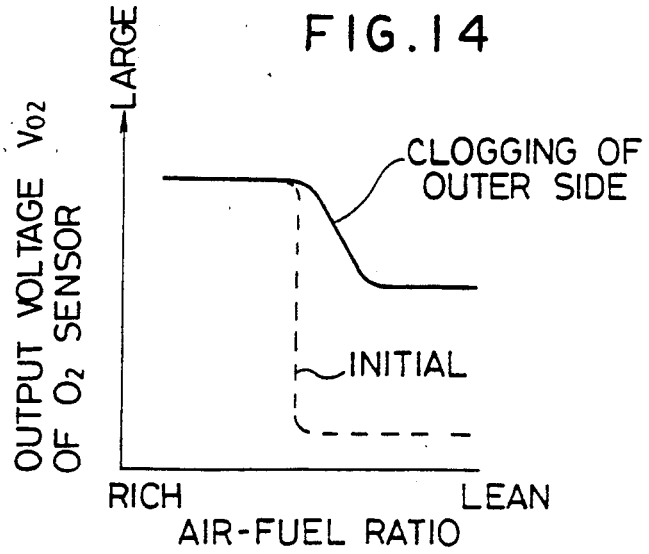
FIG. 14 has a graph illustrating changes of output characteristics caused when clogging is caused in a protecting layer of the oxygen sensor.

The output voltage $VO_2$ changes from the initial value in the above-mentioned manner, for example, when as shown in FIGS. 13 or 14, in case of the oxygen sensor 14 of the zirconia tube type, the electrode on the inner side (open air has is deteriorated, or clogging is caused in the protecting layer for protecting the outer side of the tube (see Table 1).

TABLE 1

| | Output R | Output L | Control Frequency | Response Balance (see FIG. 16) | Air-Fuel Ratio Control Point |
|---|---|---|---|---|---|
| small thermal deterioration | — | — | high | (1), b | rich |
| deterioration of inner side | low | low | — | (1), a | rich |
| clogging of outer side | — | high | low | (1), c or d | lean |
| large thermal deterioration | low | — | low | (2) or (3), a | rich |

After the output level of the oxygen sensor 14 is diagnosed in the above-mentioned manner, the diagnosis of the control frequency time is performed at step 109 and subsequent steps.

At first, at step 109, the initial value of the control frequency of the corresponding driving state is retrieved from a map of initial values of the control frequency preliminarily set according to the engine revolution number N and the basic fuel injection quantity Tp (engine load).

At step 110, the time of one frequency obtained by adding a lean time (rich control time) TMONT1 to a rich time (lean control time) TMONT1 is compared with the initial value of the time of said one frequency retrieved from the map at step 108, and if the control frequency is longer than the initial value, 1 is set at a flag f FREQUENCY NG at step 111, so that a disorder in the control frequency y can be judged by this flag f FREQUENCY NG, and at next step 112, occurrenoe of a disorder in the oxygen sensor 14 is indicated to the driver.

Figure 15:
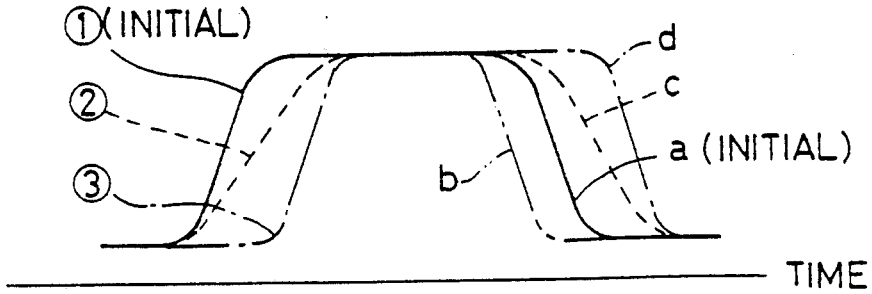
FIG. 15 is a time chart showing changes of response characteristics caused by deterioration of the oxygen sensor.
Figure 16:
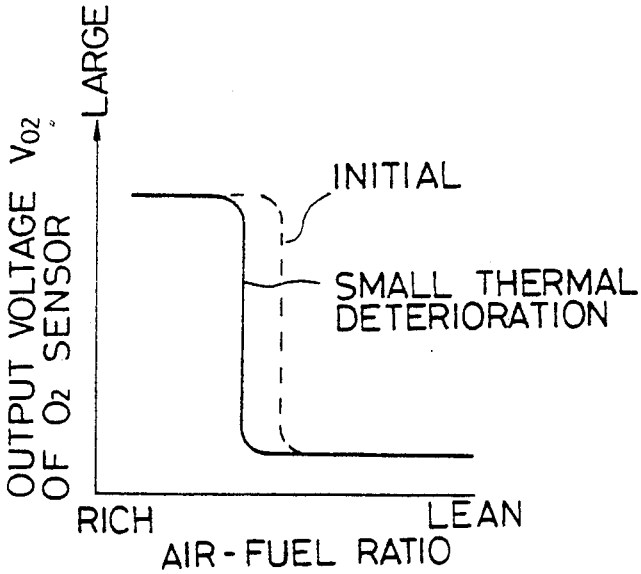
FIGS. 16 and 17 are graphs showing changes of output characteristics caused by thermal deterioration of sensor elements of the oxygen sensor.
Figure 17:
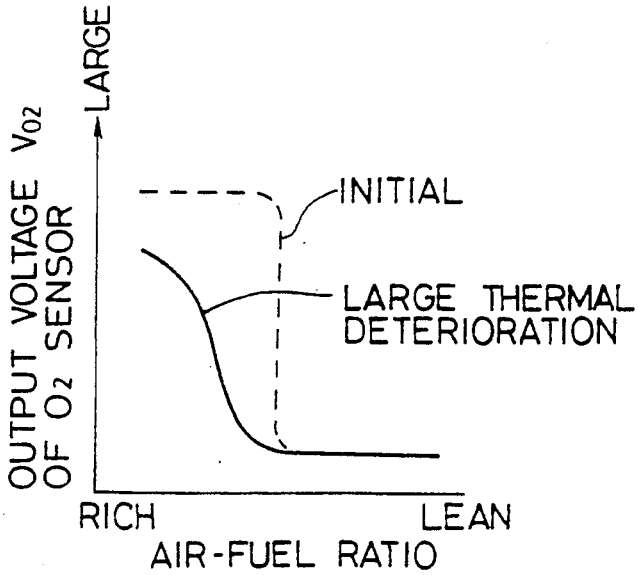

The control frequency becomes larger than the initial value when as shown in FIG. 14, clogging is caused in the protecting layer interposed between the exhaust gas, that is, the gas to be detected, and the sensor element, or as shown in FIGS. 16 and 17, thermal deterioration is caused in zirconia or the like constituting the sensor element (see Table 1 and FIG. 15).

On the other hand, when it is judged at step 110 that the control frequency is not larger than the initial value, the routine goes into step 113, and zero is set at the flag f FREQUENCY NG, so that by this flag f FREQUENCY NG, it can be judged that the control frequency is normal.

At next step 114, the state of the flag fA is judged, and when the flag fA is at zero and the output voltage $VO_2$ of the oxygen sensor 14 is substantially constant, the routine goes into step 115 and subsequent steps and the diagnosis of the oxygen sensor 14 is performed.

At step 115, according to the program of the computation of $\Delta VO_2$ shown in FIG. 6, the minimum value MAX $\Delta V(-)$ of the change quantity $\Delta VO_2$ on the positive side of the sampled output voltage $VO_2$ is added to the maximum value MAX$\Delta V(+)$ of the change quantity $\Delta VO_2$ on the positive side, and the obtained results set at M1.

At next step 116, MAX V(+) and MAX V(−) are reset at zero so that new values can be sampled.

At next step 117, the value obtained by subtracting the rich time TMONT2 from the lean time TMONT1 is set at M2, and at next step 118, the time TMONT4 of from the initial detection of the rich state to the start of the change of the air-fuel ratio in the direction toward the lean state is subtracted from the time TMONT3 of from the initial detection of the lean state to the start of the change of the air-fuel ratio in the direction toward the rich state, and the result is set at M3.

At next step 119, ML showing the difference between the speed of the change of the output of the oxygen sensor 14 in the increasing direction and the speed of the change of the output of the oxygen sensor 14 in the decreasing direction is compared with the predetermined value oorresponding corresponding the initial value of MI, and it is judged whether or not the change speed is different from the initial value. When it is judged that MI is not substantially equal to the initial value but is different from the initial value, it is presumed that a change is generated in at least one of the rich→lean response speed and the lean→rich response speed as shown in FIG. 15 and Table 1. Accordingly, the routine goes into step 123 and 1 is set at a flag f BALANCE NG, and step 124, a disorder of the oxygen sensor 14 is displayed to the drive.

At step 120, M2 indicating the difference between the rich time and the lean time during the feedback control is compared with the predetermined value corresponding to the initial value of M2, and it is judged whether or not the balance between the rich control time and the lean control time is changed from the initial value. When it is judged that the balance of the control time is changed from the initial value, since the feedback-controlled air-fuel ratio is deviated from the initial target air-fuel ratio (theoretical air-fuel ratio), also in this case, the routine goes into steps 123 and 124, and setting of the defective flag and display of a disorder are performed.

At step 121, M3 indicating the difference of the time of from the initial detection, in both directions, of the rich (lean) state to the start of the actual change of the air-fuel ratio toward the lean (rich) state by the proportional control for cancelling this rich (lean) state is compared with the predetermined value corresponding to the initial value of M3, and it is judged whether or not the response balance between the detection of the rich state and the detection of the lean state is changed from the initial Value of this response balance. When it is judged that the response balance between the detection of the rich state and the detection of the lean state is changed from the initial value and actual M3 is not substantially equal to the initial value, as in the above-mentioned case, the routine goes into steps 123 and 124, and setting of the defective flag and display of a disorder are performed.

On the other hand, when it is judged at step 121 that M3 is substantially equal to the initial value, and when all of M1, M2 and M3 are substantially equal to the initial values and no change is found in the response characteristic, the routine goes into step 122 and zero is set at the flag f BALANCE NG, so that the state of no disorder in the response characteristic can be detected.

As is apparent from the foregoing description according to the present embodiment, even if various deterioration patterns as shown in FIG. 15 and Table 1 are present in the oxygen sensor 14, peculiar changes of the characteristics of the respective deterioration patterns are detected and self-diagnosis of deterioration of the oxygen sensor 14 can be made. Accordingly, the oxygen sensor 14 can be diagnosed with a high degree of precision, and for example, by displaying the diagnosis result to the driver, he is urged to perform a maintenance operation and driving in the state where the air-fuel ratio is feedback-controlled to a level deviated from the target air-fuel ratio and the properties of the exhaust gas are worsened can be promptly evaded.

It also is possible to perform feedback control while compensating for deterioration of the oxygen sensor 14 based on the above-mentioned diagnosis result. This correction of deterioration will now be described with reference to the flow chart of FIG. 8.

Figure 8:
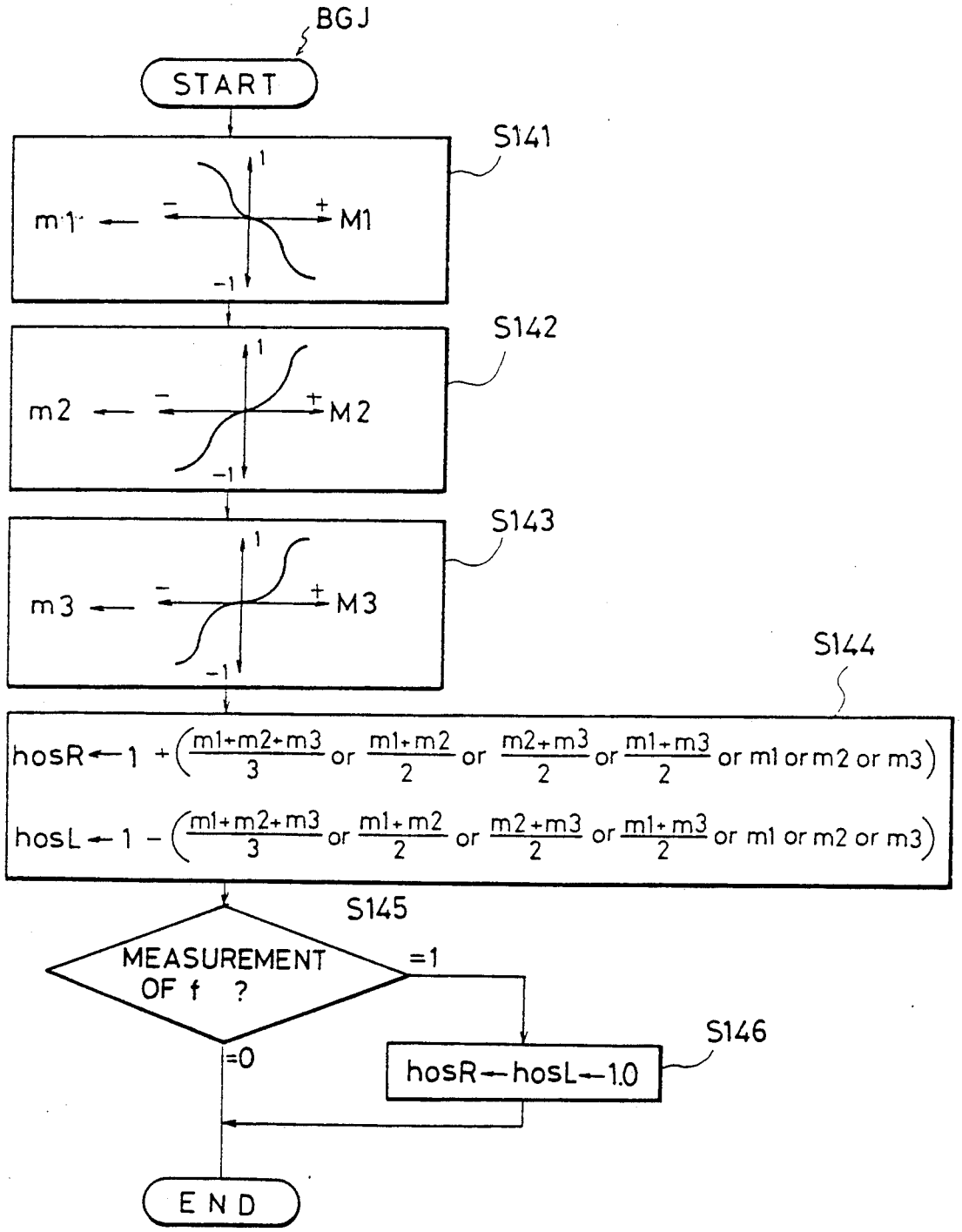

The program shown in the flow chart of FIG. 8 is conducted by the background processing. At steps 141, 142 and 143, membership values m1, m2 and m3 indicating deviation degrees of M1, M2 and M3 from the initial values are set based on preliminarily set membership functions.

The membership functions shown in the flow chart of FIG. 8 are those indicating that the initial value is zero, but the initial value may be other than zero.

At step 144, correction coefficients hosL and hos1 for correcting the proportional components pL and PR used for the proportional control of the air-fuel ratio feedback correction coefficient LAMBDA are set based on the above-mentioned membership values m1, m2 and m3.

The correction coefficients hosL and hos1 are determined, for example, by correcting the reference value of by the mean value of the membership values m1, m2 and m3, the mean value of two of these three values or one of the membership values m1, m2 and m3. In the case where the controlled air-fuel ratio tends to deviate toward the lean side and all of the membership values m1, m2 and m3 are set on the positive side and tend to deviate toward the lean side, it is necessary that the correction of increasing the feedback correction coefficient LAMBDA by the proportional control at the initial detection of the lean state should be further increased and in contrast, the correction of decreasing the correction coefficient LAMBDA by the proportional control at the initial detection of the rich state should be further decreased. Accordingly, in order that the correction coefficient hosL for correcting the proportional control component PL at the initial detection of the rich state is made smaller as the lean tendency is large and the correction coefficient hos1 for correcting the proportional control component 11 at the initial detection of the lean state is made larger as the lean tendency is large, the correction coefficient hosL is increased and set at an increased level with increase of each of the membership values m1, m2 and m3 and the correction coefficient hosR is decreased and set at a decreased level with increase of each of the membership values M1, m2 and m3, by adding a certain value to the reference value of 1 for hosL and subtracting a certain value from the reference value of 1 for hosR.

At the proportional controls at the initial detections of the rich and lean states in the proportional-integral control of the feedback correction coefficient LAMBDA shown in the fLow chart of FIG. 5, the so-set correction coefficients hosL and hosR are multiplied by the proportional control components PR and PL retrieved from the map based on the basic fuel injection quantity Tp and the engine revolution number N so that the changes of the response balance and the like by deterioration of the oxygen sensor 14 are compensated for by this correction of the proportional control portions.

At step 145, the judgment of the measurement of the flag f is performed, and at the time of the diagnosis of deterioration, that is, when it is judged that the flag f is measured to be at 1, the routine goes into step 146 and each of the correction coefficient hosL and hosR is reset at the reference value of 1.

Figure 10:
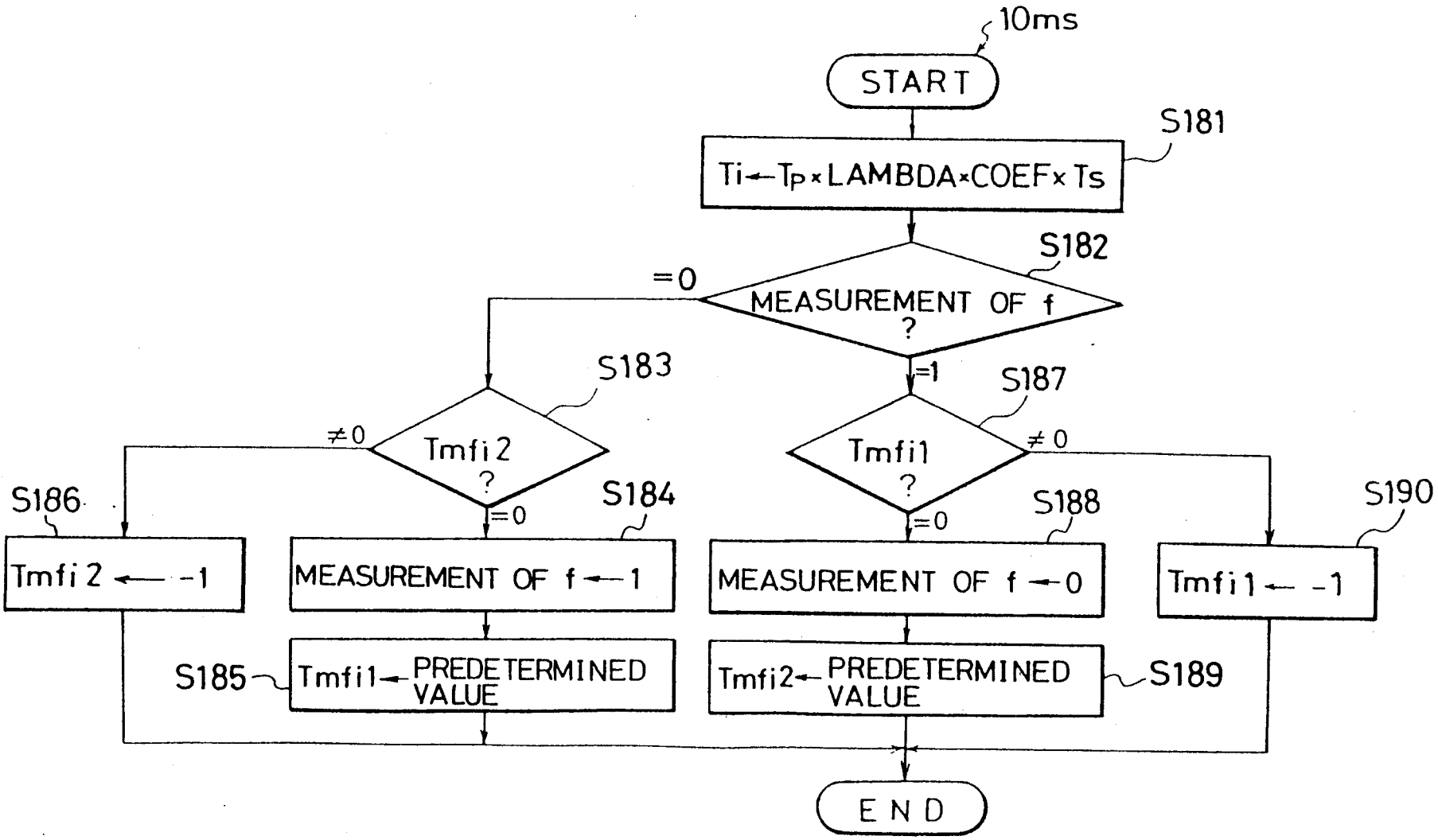
Figure 11:
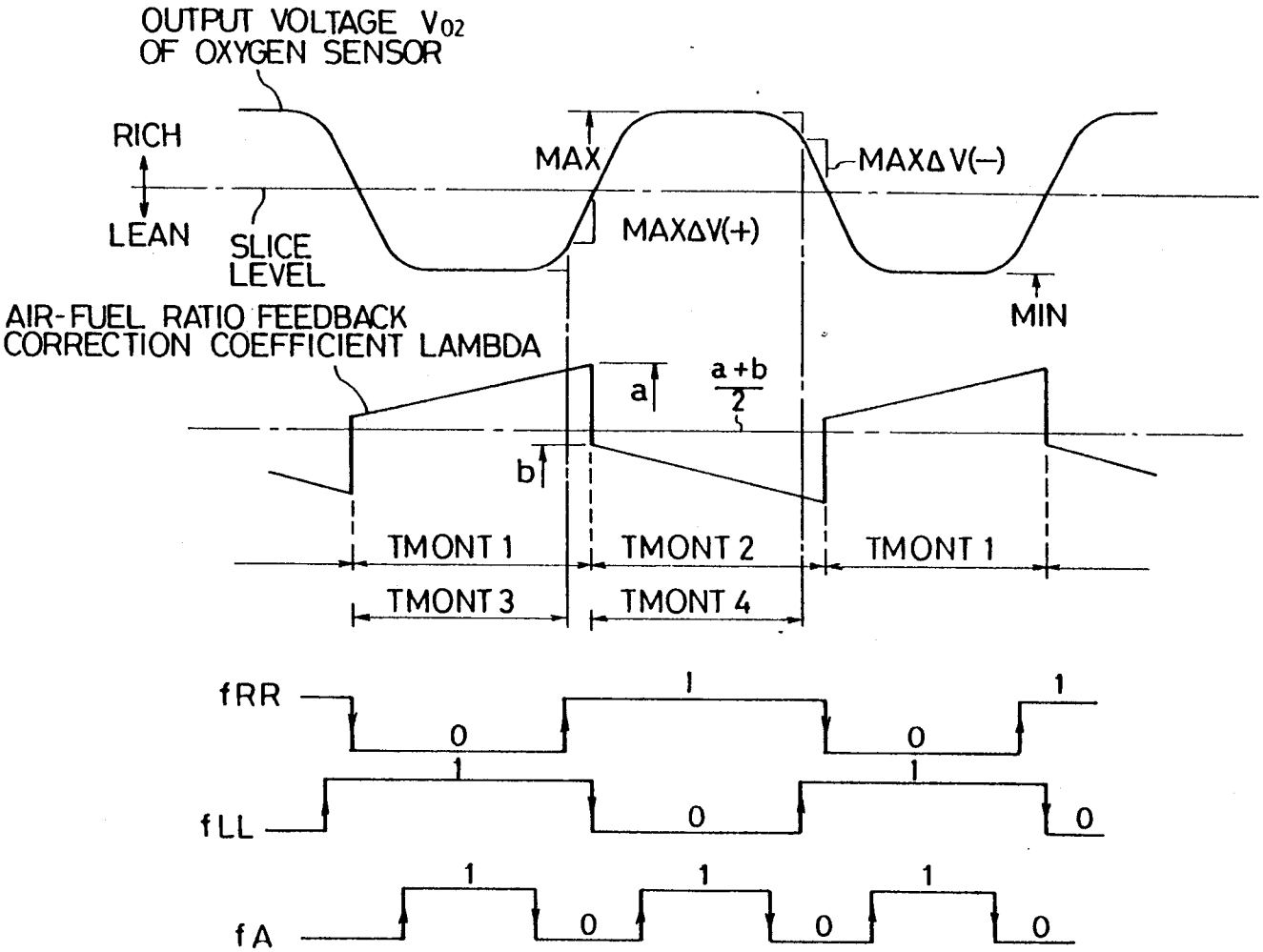
FIG. 11 is a signal timing chart indicating signal timing conditions for the present invention.

Incidentally, the air-fuel ratio feedback correction coefficient LAMBDA set by the proportional-integral control according to the program shown in the flow chart of FIG. 5 is used for the computation of the final fuel injection quantity Ti, as shown in the flow chart of FIG. 10.

The program shown in the flow chart of FIG. 10 is executed every 10 ms. At first, at step 181, the fuel injection quantity Ti is computed, for example, according to the following equation $$Ti \leftarrow Tp \times LAMBDA \times COEF + Ts$$

In the above equation, COEF represents various correction coefficients set mainly based on the cooling water temperature Tw detected by the water temperature sensor 12, and Ts represents the correction component for correcting the change of the effective open time of the fuel injection valve 10 by the change of the voltage of a battery as the driving power source.

The finally set fuel injection quantity Ti is set at an output register and at the predetermined injection timing, the newest fuel injection quantity Ti set at the output register is read out, and a driving pulse signal having a pulse width corresponding to this fuel injection quantity Ti is emitted to the fuel injection valve 10 to control the intermittent fuel injection by the fuel injection valve 10.

At next step 182, the measurement of the flag f used for the changeover control for determining whether or not the diagnosis of deterioration of the oxygen sensor 14 is carried out in the above-mentioned manner is judged. When it is judged at this step that the flag f is measured to be at zero, the routine goes into step 183, and it is judged whether or not a timer Tmfi2 for measuring the time of the non-diagnosis state is at zero. When it is judged that this timer Tmif2 is at zero, at step 184, I is set at the flag f and a predetermined value is set at a timer Tmif1 for measuring the time of the diagnosis state. When it is judged at step 183 that the timer Tmfi2 is not at zero, the routine goes into step 186 and the value of the timer Tmfi2 is reduced by 1.

In the case where 1 is set at the flag f at step 184 and the predetermined value is set at the timer Tmfi1 for measuring the time of the diagnosis state, at step 182 of the next program execution, it is judged that the flag f is measured to be at 1, and the routine goes into step 187 and it is judged whether or not the timer Tmfi1 is at zero. However, since it is judged at this step 187 that the timer Tmfi1 is not at zero, the routine goes into step 190 and the value of the timer Tmfi1 is reduced by 1. Accordingly, 1 is kept set at the measurement of the flag f until the value of the timer Tmfi1 is reduced to zero from the predetermined value by the processing at step 190, and during this period, the diagnosis of deterioration of the oxygen sensor 14 is carried out.

When the value of the timer Tmfi1 is reduced to zero, at step 188, zero is set at the measurement of the flag f and at step 189, the predetermined value is set at the timer Tmfi2. The diagnosis of deterioration is canceled and the normal control is carried out until the value of the timer Tmfi2 is reduced to zero by the processing at step 186.

Incidentally, in the present embodiment, there is adopted the structure in which an air flow meter is disposed and the basic fuel injection quantity Tp is computed based on the sucked air flow quantity detected by this air flow meter. Instead of this structure, there can be adopted a structure in which a pressure sensor for detecting the sucked air pressure PB is disposed and the basic fuel injection quantity Tp is set based on this sucked air pressure PB, or a structure in which the basic fuel injection quantity Tp is computed based on the open area of the suction system and the engine revolution number. The oxygen sensor 14 may be provided with a nitrogen oxide-reducing catalyst layer as disclosed in Japanese Unexamined Patent publication No. 64-458.

I claim:

1. A method for the detection and diagnosis of an air-fuel ratio in a fuel supply control systems of an internal combustion engine, which system comprises air-fuel ratio-detecting means for detecting an air-fuel ratio of an air-fuel mixture sucked in the engine based on the concentration of exhaust components in an exhaust gas from the engine and is obstructed so that a fuel supply quantity is feedback-controlled to bring the air-fuel ratio detected by the air-fuel ratio-detecting means close to a target air-fuel ratio, said method comprising performing an operation of proportionally changing a feedback correction value for the feedback control of the fuel supply quantity over a mean value thereof when the air-fuel ratio detected by the air-fuel ratio-detecting means is reversed from the rich level to the lean level relative to the target air-fuel ratio or vice versa, detecting at least one of the time from the point of the start of the proportional changing operation to the point of the start of the change of the air-fuel ratio to the target air-fuel ratio and the ratio of the change of a detection signal of the air-fuel ratio-detecting means during the practice of the operational changing operation, and judging a disorder of the air-fuel ratio-detecting means when at least one of said time and ratio is not substantially equal in both the change directions of the air-fuel ratio.

2. A method for the detection and diagnosis of an air-fuel ratio in a fuel supply control system of an internal combustion engine according to claim 1, wherein the judgment of a disorder of the air-fuel ratio-detecting means based on at least one of said time and ratio is carried out when the engine is stationarily driven.

3. A method for detection and diagnosis of an air-fuel ratio in a fuel supply control system of an internal combustion engine, which system comprises air-fuel ratio-detecting means for detecting an air-fuel ratio of an air-fuel mixture sucked in the engine based on the concentration of exhaust components in an exhaust gas from the engine and is constructed so that a fuel supply quantity is feedback-controlled to bring the air-fuel ratio detected by the air-fuel ratio-detecting means close to a target air-fuel ratio, said method being characterized in that after a driving condition where the exhaust gas temperature exceeds a predetermined level is experienced, maximum and minimum values of the detection signal by said air-fuel ratio-detecting means are sampled and a disorder of the air-fuel ratio-detecting means is judged by comparing the maximum and minimum values with the initial values.

4. A method for the detection and diagnosis of an air-fuel ratio in a fuel supply control system of an internal combustion engine according to claim 3, wherein the judgment of a disorder of the air-fuel ratio-detecting means based on the maximum and minimum values of the detection signal is carried out when the engine is stationarily driven.

5. A method for the detection and diagnosis of an air-fuel ratio in a fuel supply control system of an internal combustion engine, which system comprises air-fuel ratio-detecting means for detecting an air-fuel ratio of an air-fuel mixture sucked in the engine based on the concentration of exhaust components in an exhaust gas from the engine and is obstructed so that a fuel supply quantity is feedback-controlled to bring the air-fuel ratio detected by the air-fuel ratio-detecting means close to a target air-fuel ratio, said method being characterized in that the frequency of the control of the feedback correction value for the feedback control of the fuel supply quantity is detected, initial values of this control frequency for respective driving conditions are stored, and the detected control frequency is compared with the initial value of the control frequency stored according to the corresponding driving condition to judge a disorder of the air-fuel ratio-detecting means.

6. A method for the detection and diagnosis of an air-fuel ratio in a fuel control system of an internal combustion engine according to claim 5, wherein the judgment of a disorder of the air-fuel ratio-detecting means based on the control frequency is carried out when the engine is stationarily driven.

7. An apparatus for the detection and diagnosis of an air-fuel ratio in a fuel supply control system of an internal combustion engine, which system comprises air-fuel ratio-detecting means for emitting a detection signal corresponding the concentration of exhaust components in an exhaust gas from the engine and detecting an air-fuel ratio in an air-fuel mixture sucked in the engine based on the detection signal, feedback correction value setting means for setting a feedback correction value for feedback-controlling a fuel supply quantity so as to bring the air-fuel ratio detected by the air-fuel ratio-detecting means to a target air-fuel ratio and fuel supply-controlling means for controlling the supply of the fuel to the engine based on the fuel supply quantity overrated based on the feedback correction value set by the feedback correction value-setting means, said apparatus comprising proportional operation-controlling means for causing the feedback correction value-setting means to perform the setting of the feedback correction value by a proportional operation of increasing or decreasing the feedback correction value over at least a mean value of the feedback correction value when rich-lean reversal of the actual air-fuel ratio relative to the target air-fuel ratio is detected by the air-fuel ratio-detecting means, proportional operation result-detecting means for detecting at least one of the time of from the start of the proportional operation of increasing or decreasing the feedback correction value by the proportional operation-controlling means to the start of the change of the air-fuel ratio toward the target air-fuel ratio and the ratio of the change of the detection signal of the air-fuel ratio-detecting means, and response level disorder-judging means for judging a disorder of the air-fuel ratio-detecting means when the values detected by the proportional operation result-detecting means in both the change directions of the air-fuel ratio are not substantially equal to each other.

8. An apparatus for the detection and diagnosis of an air-fuel ratio in a fuel supply control system of an internal combustion engine according to claim 7, which further comprises stationary driving-detecting means and disorder judgment-allowing means for allowing the judgment of a disorder of the air-fuel ratio-detecting means only when the stationary driving state of the engine is detected by the stationary driving-detecting means.

9. An apparatus for the detection and diagnosis of an air-fuel ratio in a fuel supply control system of an internal combustion engine, which system comprises air-fuel ratio-detecting means for emitting a detection signal corresponding the concentration of exhaust components in an exhaust gas from the engine and detecting an air-fuel ratio in an air-fuel mixture sucked in the engine based on the detection signal, feedback correction value-setting means for setting a feedback correction value for feedback-controlling a fuel supply quantity so as to bring the air-fuel ratio detected by the air-fuel ratio-detecting means to a target air-fuel ratio and fuel supply-controlling means for controlling the supply of the fuel to the engine based on the fuel supply quantity corrected based on the feedback correction value set by the feedback correction value-setting means, said apparatus comprising maximum value-sampling and minimum value-sampling means for sampling maximum and minimum values of the detection signal given by the air-fuel ratio-detecting means, high exhaust gas temperature occurrence-judging means for judging the occurence of a driving condition where the exhaust gas temperature is higher than a predetermined level, and output level disorder-judging means for judging a disorder of the air-fuel ratio-detecting means by comparing the maximum and minimum values sampled by the maximum value-sampling and minimum value-sampling means with the initial values when the occurrence of the driving condition where the exhaust gas temperature is higher than the predetermined level is judged.

10. An apparatus for the detection and diagnosis of an air-fuel ratio in a fuel supply control system of an internal combustion engine according to claim 9, which further comprises stationary driving-detecting means and disorder judgment-allowing means for allowing the judgment of a disorder of the air-fuel ratio-detecting means only when the stationary driving state of the engine is detected by the stationary driving-detecting means.

11. An apparatus for the detection and diagnosis of an air-fuel ratio in a fuel supply control system of an internal combustion engine, which system comprises air-fuel ratio-detecting means for emitting a detection signal corresponding the concentration of exhaust components in a exhaust gas from the engine and detecting an air-fuel ratio in an air-fuel mixture sucked in the engine based on the detection signal, feedback correction value-setting means for setting a feedback correction value for feedback-controlling a fuel supply quantity so as to bring the air-fuel ratio detected by the air-fuel ratio-detecting means to a target air-fuel ratio and fuel supply-controlling means for controlling the supply of the fuel to the engine based on the fuel supply quantity corrected based on the feedback correction value set by the feedback correction value-setting means, said apparatus comprising control frequency-detecting means for detecting the control frequency of the feedback correction value set by the feedback correction value-setting means, initial value-storing means for storing the initial value of the control frequency of the feedback correction value according to the driving condition, and control frequency disorder-judging means for judging a disorder of the air-fuel ratio-detecting means by comparing the control frequency of the feedback correction value detected by the control frequency-detecting means with the initial value of the control frequency, stored in the initial value-storing means, according to said driving condition. feedback-controlling feedback feedback

12. An apparatus for the detection and diagnosis of an air-fuel ratio in a fuel supply control system of an internal combustion engine according to claim 11, which further comprises stationary driving-detecting means and disorder judgment-allowing means for allowing the judgment of a disorder of the air-fuel ratio-detecting means only when the stationary driving state of the engine is detected by the stationary driving-detecting means.

* * * * *